US008013509B2

(12) United States Patent
Moriguchi et al.

(10) Patent No.: US 8,013,509 B2
(45) Date of Patent: Sep. 6, 2011

(54) ELECTRON-EMITTING DEVICE, ELECTRON SOURCE, AND IMAGE DISPLAY APPARATUS, AND METHOD FOR MANUFACTURING THE SAME

(75) Inventors: Takuto Moriguchi, Chigasaki (JP); Koki Nukanobu, Machida (JP); Takahiro Sato, Ebina (JP); Takeo Tsukamoto, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 12/297,847

(22) PCT Filed: Jun. 29, 2007

(86) PCT No.: PCT/JP2007/063528

§ 371 (c)(1),
(2), (4) Date: Oct. 20, 2008

(87) PCT Pub. No.: WO2008/013040

PCT Pub. Date: Jan. 31, 2008

(65) Prior Publication Data

US 2009/0237570 A1 Sep. 24, 2009

(30) Foreign Application Priority Data

Jul. 25, 2006 (JP) ..... 2006-202140

(51) Int. Cl.
*H01J 63/04* (2006.01)

(52) U.S. Cl. ..... 313/495; 313/238; 313/310; 315/169.3

(58) Field of Classification Search ..... 313/310, 313/345, 238; 315/169.3
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,786,658 | A | 7/1998 | Tsukamoto et al. | 313/309 |
| 5,847,495 | A | 12/1998 | Yamanobe et al. | |
| 5,986,389 | A | 11/1999 | Tsukamoto | 313/310 |
| 6,147,449 | A | 11/2000 | Iwasaki et al. | 313/495 |
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,231,413 | B1 | 5/2001 | Tsukamoto | 445/24 |
| 6,246,168 | B1 | 6/2001 | Kishi et al. | 313/495 |
| 6,288,494 | B1 | 9/2001 | Tsukamoto et al. | 315/169.1 |
| 6,384,542 | B2 * | 5/2002 | Tsukamoto | 315/160 |
| 6,435,928 | B1 | 8/2002 | Tsukamoto | 445/24 |
| 6,472,814 | B1 | 10/2002 | Yamanobe et al. | 313/495 |
| 6,515,640 | B2 | 2/2003 | Tsukamoto et al. | 345/75.2 |
| 6,608,437 | B1 | 8/2003 | Kishi et al. | 313/495 |
| 6,626,719 | B2 | 9/2003 | Ono et al. | 445/24 |
| 6,835,110 | B2 | 12/2004 | Mizuno et al. | 445/6 |

(Continued)

FOREIGN PATENT DOCUMENTS

EP 1 753 006 A2 2/2007

(Continued)

*Primary Examiner* — Peter Macchiarolo
(74) *Attorney, Agent, or Firm* — Fitzpatrick, Cella, Harper & Scinto

(57) ABSTRACT

A base body includes a first part and a second part. The second part has a lower thermal conductivity than the first part and is arranged adjacently to the first part. A first conductive film is formed on the first part and a second conductive film is formed on the second part. At least part of a gap is located above a boundary between the first part and the second part.

18 Claims, 17 Drawing Sheets

U.S. PATENT DOCUMENTS

| | | | | |
|---|---|---|---|---|
| 6,843,696 | B2 | 1/2005 | Kitamura et al. | 445/24 |
| 6,848,962 | B2 | 2/2005 | Kitamura et al. | 445/24 |
| 6,849,999 | B1 * | 2/2005 | Kobayashi et al. | 313/495 |
| 6,858,990 | B2 | 2/2005 | Tsukamoto | 315/169.1 |
| 6,896,571 | B2 | 5/2005 | Mizuno et al. | 445/24 |
| 6,900,581 | B2 | 5/2005 | Kyogaku et al. | 313/310 |
| 6,948,995 | B2 | 9/2005 | Ishikura et al. | 445/51 |
| 7,012,362 | B2 | 3/2006 | Kawate et al. | 313/495 |
| 7,034,444 | B2 | 4/2006 | Tsukamoto | 313/309 |
| 7,057,336 | B2 | 6/2006 | Kishi et al. | 313/495 |
| 7,064,475 | B2 | 6/2006 | Kuroda et al. | 313/311 |
| 7,067,336 | B1 | 6/2006 | Kyogaku et al. | 438/20 |
| 7,074,105 | B2 | 7/2006 | Kawate et al. | 445/51 |
| 7,074,380 | B2 | 7/2006 | Iwaki et al. | 423/447.3 |
| 7,077,716 | B2 | 7/2006 | Mizuno et al. | 445/24 |
| 7,094,123 | B2 | 8/2006 | Oyama et al. | 445/50 |
| 7,131,886 | B2 | 11/2006 | Kitamura et al. | 445/51 |
| 7,147,533 | B2 | 12/2006 | Kawate et al. | 445/49 |
| 7,186,160 | B2 | 3/2007 | Tsukamoto | 445/50 |
| 7,198,966 | B2 | 4/2007 | Kitamura et al. | 438/20 |
| 7,227,311 | B2 | 6/2007 | Tsukamoto | 315/169.3 |
| 7,234,985 | B2 | 6/2007 | Kishi et al. | 445/24 |
| 7,258,590 | B2 | 8/2007 | Oyama et al. | 445/50 |
| 7,271,529 | B2 | 9/2007 | Takeda et al. | 313/311 |
| 7,298,079 | B2 | 11/2007 | Danjo et al. | 313/495 |
| 7,312,561 | B2 | 12/2007 | Moriguchi et al. | 313/310 |
| 7,399,215 | B2 | 7/2008 | Tsukamoto | 445/51 |
| 7,419,416 | B2 | 9/2008 | Tsukamoto | 445/24 |
| 7,432,883 | B2 | 10/2008 | Oyama et al. | 345/75.2 |
| 7,442,404 | B2 | 10/2008 | Kuroda et al. | 427/74 |
| 7,459,844 | B2 | 12/2008 | Tsukamoto | 313/495 |
| 7,679,278 | B2 * | 3/2010 | Nukanobu et al. | 313/495 |
| 2002/0084736 | A1 * | 7/2002 | Shibata | 313/310 |
| 2005/0134161 | A1 | 6/2005 | Kitamura et al. | 313/309 |
| 2005/0227062 | A1 | 10/2005 | Sato et al. | 428/323 |
| 2005/0258734 | A1 | 11/2005 | Nukanobu et al. | 313/495 |
| 2005/0282458 | A1 | 12/2005 | Takeda et al. | 445/46 |
| 2005/0287689 | A1 | 12/2005 | Iwaki et al. | 438/22 |
| 2006/0228478 | A1 | 10/2006 | Iwaki et al. | 427/249.1 |
| 2007/0018561 | A1 * | 1/2007 | Nukanobu et al. | 313/495 |
| 2007/0141943 | A1 | 6/2007 | Kawate et al. | 445/50 |
| 2007/0188067 | A1 | 8/2007 | Tsukamoto et al. | 313/309 |
| 2007/0190672 | A1 | 8/2007 | Kitamura et al. | 438/20 |
| 2008/0045112 | A1 | 2/2008 | Kishi et al. | 445/24 |
| 2008/0106181 | A1 | 5/2008 | Kawate et al. | 313/495 |
| 2008/0122336 | A1 | 5/2008 | Nukanobu et al. | 313/310 |
| 2010/0120319 | A1 * | 5/2010 | Nukanobu et al. | 445/24 |

FOREIGN PATENT DOCUMENTS

| | | |
|---|---|---|
| JP | 01-279538 | 11/1989 |
| JP | 01-279557 | 11/1989 |
| JP | 02-247940 | 10/1990 |
| JP | 04-094032 | 3/1992 |
| JP | 04-132138 | 5/1992 |
| JP | 07-201274 | 8/1995 |
| JP | 08-096699 | 4/1996 |
| JP | 09-293448 | 11/1997 |
| JP | 2002-051619 | 2/2002 |

* cited by examiner

ELECTRON-EMITTING DEVICE, ELECTRON SOURCE, AND IMAGE DISPLAY APPARATUS, AND METHOD FOR MANUFACTURING THE SAME

CROSS REFERENCE TO RELATED APPLICATIONS

This Application is a National Stage filing under 35 U.S.C. §371 of International Application No. PCT/JP2007/063528, filed Jun. 29, 2007, and claims priority to Japanese Patent Application No. 2006-202140, filed Jul. 25, 2006, each of which is incorporated by reference herein in its entirety, as if set forth fully herein.

BACKGROUND OF THE INVENTION

1. Field of the Invention

The present invention relates to an electron-emitting device and an electron source using the same and an image display apparatus using the same. Moreover, the present invention relates to an information reproducing apparatus such as a television receiver that receives a broadcast signal of a television broadcast and displays and reproduces image information, character information, and voice information, which are included in the received broadcast signal.

2. Description of the Related Art

A conventional process for manufacturing a surface conduction electron-emitting device is schematically shown with reference to FIG. 17. First, a pair of auxiliary electrodes 2, 3 are formed on a substrate 1 (FIG. 17A). Next, the pair of auxiliary electrodes 2, 3 are connected to each other by a conductive film 4 (FIG. 17B). Then, a voltage is applied between the pair of auxiliary electrodes 2, 3 to form a first gap 7 in a portion of the conductive film 4 (FIG. 17C). This processing is called "current passing forming". The "current passing forming" processing is a process of passing a current through the conductive film 4 to form the first gap 7 in the portion of the conductive film 4 by joule heat developed by the current. A pair of electrodes 4*a*, 4*b* opposite to each other across the first gap 7 are formed by the processing of "current passing forming". Then, the pair of electrodes 4*a*, 4*b* are subjected to processing called "activation". The "activation" processing is processing such that a voltage is applied between the pair of auxiliary electrodes 2, 3 in an atmosphere of gas containing carbon. With this processing, a conductive carbon film 21*a*, 21*b* can be formed on the substrate 1 in the first gap 7 and the electrodes 4*a*, 4*b* near the first gap 7 (FIG. 17D). An electron-emitting device is formed by the foregoing processing.

FIG. 16A is a plan view to schematically show an electron-emitting device subjected to the foregoing "activation" processing. FIG. 16B is a schematic cross-sectional view along a line B-B' in FIG. 16A, which is basically equivalent to FIG. 17D. In FIG. 16A and FIG. 16B, parts denoted by the same reference numbers as shown in FIG. 17 denote the same parts as shown in FIG. 17. When electrons are emitted from the electron-emitting device, an electric potential applied to one auxiliary electrode 2 or 3 is made higher than an electric potential applied to the other auxiliary electrode 3 or 2. When the voltage is applied between the auxiliary electrode 2 and the auxiliary electrode 3 in this manner, a strong electric field is developed in a second gap 8. As a result, it is thought that electrons tunnel from many points (a plurality of electron-emitting parts) in a portion that forms the end edge of the carbon film 21*a* or 21*b* connected to the auxiliary electrode 3 or 2 on the lower electric potential side and forms the outer edge of the second gap 8, and that at least some of the electrons are emitted.

In the below-listed patent documents 1 to 6 there is disclosed a technology for controlling the shape of the foregoing auxiliary electrodes 2, 3 and the shape of the conductive film 4 to control the position of the gap.

An image display apparatus can be constructed by arranging a substrate having an electron source constructed of a plurality of electron-emitting devices of this kind opposite to a substrate having a fluorescent film formed of a fluorescent substance or the like and by keeping the interior of the two substrates in a vacuum.

[Patent document 1] Japanese Patent Application Laid-Open No. 1-279557

[Patent document 2] Japanese Patent Application Laid-Open No. 2-247940

[Patent document 3] Japanese Patent Application Laid-Open No. 4-094032

[Patent document 4] Japanese Patent Application Laid-Open No. 4-132138

[Patent document 5] Japanese Patent Application Laid-Open No. 7-201274

[Patent document 6] Japanese Patent Application Laid-Open No. 8-096699

SUMMARY OF THE INVENTION

In modern image display apparatuses, it is required that a displayed image be stably displayed for a long time. For this reason, in an image display apparatus having an electron source constructed of a plurality of electron-emitting devices, it is required that the respective electron-emitting devices can keep excellent characteristics for a long time.

Moreover, as described above, it is thought that electrons tunnel from many points that form a part of the end edge of one carbon film 21*a* or 21*b* and construct the outer edge of the gap 8. For example, when the electron-emitting device is driven with the electric potential of the first auxiliary electrode 2 made higher than the electric potential of the second auxiliary electrode 3, the second carbon film 21*b* connected to the second auxiliary electrode 3 via the second electrode 4*b* corresponds to an emitter. As a result, it can be thought that many electron-emitting parts exist in a portion that is the end edge of the second carbon film 21*b* and forms the outer edge of the second gap 8. In other words, it can be thought that many electron-emitting parts are arranged in the end edge of the carbon film 21*a* or 21*b* connected to the auxiliary electrode 3 or 2 having the lower electric potential applied thereto. For this reason, the electron-emitting parts, which are arranged at the edge of the carbon film 21*a* or 21*b* connected to the auxiliary electrode 3 or 2 having a lower electric potential applied thereto, have current passed therethrough, thereby being brought into high temperature. When the electron-emitting parts are brought into excessively high temperature, the carbon film gradually disappears. As a result, it can be thought that there are cases where these electron-emitting devices may deteriorate in the quantity of emission of the electrons over time. On the other hand, it can be thought that there are cases where carbon film 21*a* or 21*b* connected to the auxiliary electrode 3 or 2 having the higher electric potential applied thereto may adsorb gas or the like remaining in the atmosphere and, as a result, may vary in the electron emission characteristics.

For these reasons, in the electron source constructed of many electron-emitting devices, there are cases where there is deterioration in the quantity of emission of the electrons and variations in the electron emission characteristics, which can be thought to be caused by the disappearance of the carbon film and by the adsorption of the remaining gas. Moreover, in the image display apparatus using the electron-emitting device, there are cases where there is deterioration in brightness and variations in brightness, which can be thought to be caused by the variations in the electron emission characteristics. Hence, it is difficult to produce an excellent display image with high definition over a long period of use of the apparatus.

So, in view of the above problems, one object of the present invention is to provide an electron-emitting device having electron emission characteristics having stability for a long time. At the same time, another object of the present invention is to provide a method for manufacturing an electron-emitting device having electron emission characteristics having stability for a long time with ease and excellent controllability. Moreover, still another object of the present invention is to provide an electron source having electron emission characteristics having stability for a long time and a method for manufacturing the same. At the same time, still another object of the present invention is to provide an image display apparatus having a long life and a method for manufacturing the same.

So, the present invention has been made to solve the foregoing problems. The present invention is an electron-emitting device which includes a first conductive film and a second conductive film that are arranged on a base body with a gap between them and in which an electric potential of the second conductive film is made higher than an electric potential of the first conductive film to emit an electron, and the electron-emitting device is characterized in that: the base body includes a first part and a second part; the second part has a lower thermal conductivity than the first part and is arranged adjacently to the first part; the first conductive film is formed on the first part and the second conductive film is formed on the second part; and at least part of the gap is located above a boundary between the first part and the second part.

Further, the present invention is an electron-emitting device which includes a first conductive film and a second conductive film that are arranged separately from each other on a base body and in which an electric potential of the second conductive film is made higher than an electric potential of the first conductive film to emit an electron, and the electron-emitting device is characterized in that: the base body includes a first part and a second part; the second part has a lower thermal conductivity than the first part and is arranged adjacently to the first part; the first conductive film is formed on the first part and the second conductive film is formed on the second part; and at least part of a boundary between the first part and the second part is located between the first conductive film and the second conductive film.

The present invention is characterized also by an electron source including a plurality of electron-emitting devices of the present invention described above and by an image display apparatus including the foregoing electron source and a light-emitting substance.

The present invention is characterized also by an information reproducing apparatus including at least a receiver that outputs at least one of image information, character information, and voice information, which are included in a received broadcast signal, and the foregoing image display apparatus connected to the receiver.

The present invention is a method for manufacturing an electron-emitting device, and the method includes at least a first step for preparing a base body having a first electrode and a second electrode arranged separately from the first electrode and a second step for applying a pulse voltage between the first electrode and the second electrode a plurality of times in an atmosphere containing gas containing carbon, and is characterized in that: the base body includes a first part and a second part; that the second part has a lower thermal conductivity than the first part and is arranged adjacently to the first part; the first electrode and the second electrode are formed on the base body in such a way that a boundary between the first part and the second part is located between the first electrode and the second electrode; and the waveform of the pulse voltage includes a waveform that makes an electric potential of the first electrode higher than the electric potential of the second electrode and a waveform that makes the electric potential of the second electrode higher than the electric potential of the first electrode.

According to the present invention, excellent electron emission characteristics can be maintained for a long time. As a result, it is possible to provide an image display apparatus and an information display/reproduction apparatus capable of displaying a high-quality display image having little variation in brightness.

DESCRIPTION OF THE EMBODIMENTS

Hereinafter, an electron-emitting device and a method for manufacturing the same of the present invention will be described, but materials and values to be shown below are only examples. The materials and values to be shown below can be variously modified in such a way as to be suitable for applications if the modified materials and values are within a range that achieves the object of the present invention and produces the effect of the present invention.

Various preferred embodiments of the electron-emitting device of the present invention will be described below.

First Embodiment

Figure 13A:
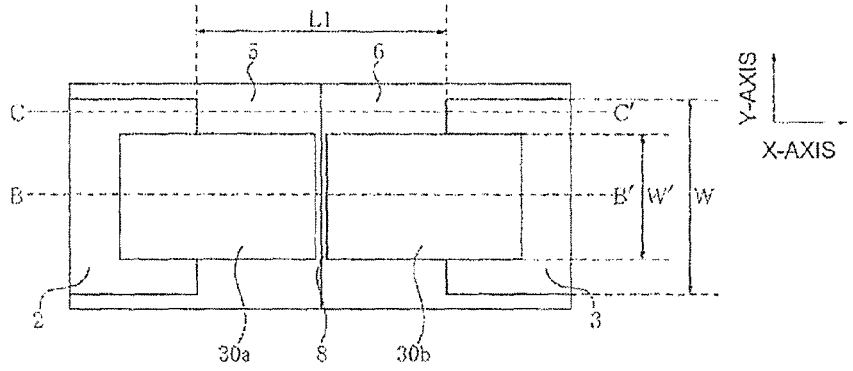
FIGS. 13A to 13C are schematic views to show the construction of an electron-emitting device of the present invention.
Figure 13B:
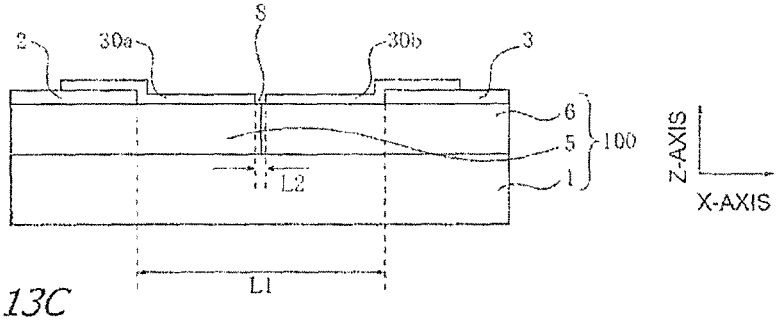
Figure 13C:
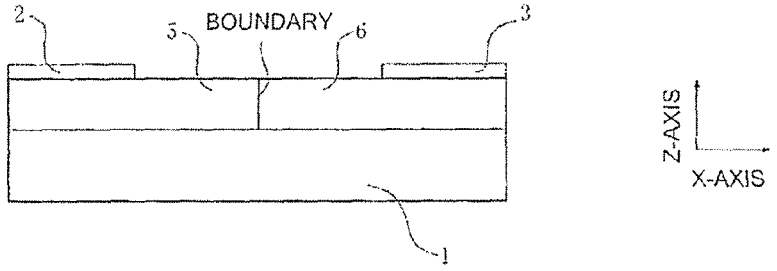

First, the fundamental construction of a first embodiment of the most typical embodiment of the electron-emitting device of the present invention will be described with reference to FIGS. 13A to 13C. FIG. 13A is a schematic plan view to show a typical construction in this embodiment. FIGS. 13B and 13C are schematic cross-sectional views along a line B-B' and a line C-C' in FIG. 13A.

In the embodiment shown in FIGS. 13A to 13C is shown an embodiment in which a base body 100 is constructed of a substantially insulating substrate 1, a first part 5, and a second part 6. The second part 6 has lower thermal conductivity than the first part 5.

A first auxiliary electrode 2 and a second auxiliary electrode 3 are arranged on the base body 100 with a gap L1 between them. The first auxiliary electrode 2 has a first conductive film 30*a* connected thereto and the second auxiliary electrode 3 has a second conductive film 30*b* connected thereto. Here, the auxiliary electrodes 2, 3 are used for supplying the conductive films 30*a*, 30*b* with an electric potential and hence can be omitted.

The first conductive film 30*a* is opposite to the second conductive film 30*b* across a gap 8. In other words, the first conductive film 30*a* and the second conductive film 30*b* are arranged separately from each other. For this reason, the gap 8 is located between the first auxiliary electrode 2 and the second auxiliary electrode 3. Hence, at least part of the first conductive film 30*a* is formed on the first part 5 and at least part of the second conductive film 30*b* is formed on the second part 6.

The gap 8 is located above the boundary between the first part 5 and the second part 6. That is, the boundary of the first part 5 and the second part 6 is arranged between the first conductive film 30*a* and the second conductive film 30*b* (directly below the gap 8). The width L2 of the gap 8 is practically set to 1 nm to 10 nm so as to make a driving voltage 30 V or less in consideration of driver's cost and to prevent electric discharge from being developed by unexpected fluctuations in voltage at the time of drive.

Here, in FIG. 13, the first conductive film 30*a* and the second conductive film 30*b* are shown as two films that are completely separated from each other. However, the gap 8 has an extremely narrow width, as described above, so the integration of the gap 8, the first conductive film 30*a*, and the second conductive film 30*b* can be expressed as "a conductive film having a gap". For this reason, the electron-emitting device of the present invention can be called an electron-emitting device that emits electrons when a voltage is applied across one end and the other end edge of the conductive film having a gap at the time of drive.

Moreover, there are also cases where the first conductive film 30*a* and the second conductive film 30*b* are connected to each other in an extremely small area. The extremely small area can be allowed because the area has high resistance and hence produces only a limited effect on the electron emission characteristics. An embodiment in which the first conductive film 30*a* and the second conductive film 30*b* are connected to each other in a part in this manner can be also expressed as "a conductive film having a gap".

In FIG. 13A is shown an example in which the gap 8 is formed in a straight shape. The gap 8 is preferably formed in the straight shape but is not limited to the straight shape. The gap 8 may be formed in a specified shape such as a shape bent at specified intervals, a circular arc shape, or a shape of a combination of a circular arc and a straight line.

Here, the gap 8 is constructed in such a way that the end edge (outer edge) of the first conductive film 30*a* is opposite to the end edge (outer edge) of the second conductive film 30*b*.

When this electron-emitting device is driven (emits electrons), a higher electric potential is applied to the second auxiliary electrode 3 than to the first auxiliary electrode 2. It is thought that this electron-emitting device has many electron-emitting parts in a portion which is a portion of the end edge of the first conductive film 30*a* and constructs the outer edge of the gap 8. It is thought that the first conductive film 30*a* connected to the first auxiliary electrode 2 corresponds to an emitter. That is, it is thought that many electron-emitting parts exist in the portion which is the portion of the end edge of the first conductive film 30*a* and constructs the outer edge of the gap 8.

The gap 8 can be formed also by subjecting the conductive film to various kinds of high-definition working processes of nano scale such as an FIB (focused ion beam). For this reason, the gap 8 of the electron-emitting device of the present invention is not limited to a gap formed by "current passing forming" processing or "activation" processing which will be described later.

In this regard, in FIGS. 13A to 13C is shown the embodiment in which the base body 100 is constructed of the substrate 1, and the first part 5 and the second part 6 that are formed on the substrate 1 separately. However, the first part 5 and the second part 6 may be formed as parts of the substrate 1.

However, as described above, the second part 6 is lower in thermal conductivity than the first part 5. Moreover, a third part that is different in thermal conductivity from the first part 5 and the second part 6 may be arranged in an area where the auxiliary electrodes 2, 3 and the conductive films 30*a*, 30*b* are not arranged on the substrate 1. Such an area is, for example, an area except for an area under the first auxiliary electrode 2 and the second auxiliary electrode 3 or an area except for an area between the first auxiliary electrode 2 and the second auxiliary electrode 3.

The employment of this construction can suppress deterioration with elapse of time in the electron emission characteristics. This reason is not clear but it can be thought that the existence of the first part 2 having high thermal conductivity under the first conductive film 30*a* corresponding to the emitter can suppress a temperature increase in the first conductive film 30*a* when the electron-emitting device is driven. With this, while the electron-emitting device is driven, the quantum mechanical tunnel phenomenon of the electron from the first conductive film 30*a* can be stably developed. Moreover, it is thought that since the second part 6 having lower thermal conductivity exists directly under the second conductive film 30*b* near the gap 8, when the electron-emitting device is driven, the temperature of the second conductive film 30*b* can be kept high by the collisions of electrons tunneling from the first conductive film 30*a*. This can prevent the remaining gas from being adsorbed by the surface of the second conductive film 30*b* and hence can suppress a secular change in the surface of the second conductive film 30*b*. For this reason, in the electron-emitting device of the present invention, it is thought that when the electron-emitting device is driven, the electron emission characteristics can be made stable and the life of electron emission current Ie (or brightness) is elongated and a driving state is stabilized.

To produce the foregoing effect, at least a part of the gap 8 needs to be located above the boundary between the first part 5 and the second part 6. That is, the boundary between the first part 5 and the second part 6 needs to be located in the gap 8. Of course, as shown in FIG. 13A, it is preferable that the boundary between the first part 5 and the second part 6 is surely located between the first conductive film 30*a* and the second conductive film 30*b* in an X-Y plane. However, an embodiment in which a part of the gap 8 deviates from the boundary between the first part 5 and the second part 6 is not excluded, if the part is within a range capable of producing the effect of the present invention.

For this reason, practically, it is preferably that the boundary between the first part 5 and the second part 6 is located inside the gap 8 in an area of 80% or more of the area (gap 8) between the first conductive film 30*a* and the second conductive film 30*b* in the X-Y plane of the electron-emitting device. In other words, practically, it is preferable that the boundary between the first part 5 and the second part 6 exists in a cross section of 80% or more of many cross sections (X-Z plane) of the electron-emitting device passing the gap 8 between the first and second conductive films 30*a* and 30*b*. Alternatively, in still other words, it is preferable that the area of 80% or more of the area (gap 8) between the first conductive film 30*a* and the second conductive area 30*b* in the X-Y plane of the electron-emitting device is separated by the boundary between the first part 5 and the second part 6.

In this regard, the embodiment has been shown here in which the first part 5 is in direct contact with the first conductive film 30*a* and in which the second part 6 is in direct contact with the second conductive film 30*b*. However, another layer may be arranged between the first part 5 and the first conductive film 30*a* and between the second part 6 and the second conductive film 30*b*, if this construction can produce the same effect of the present invention. Further, the first part 5 and the second part 6 are not necessarily homogeneous across their entire extensions, if this construction can produce the same effect of the present invention.

A conductive material such as metal and semiconductor can be used as the material of the conductive films 30*a*, 30*b*. For example, metal such as Pd, Ni, Cr, Au, Ag, Mo, W, Pt, Ti, Al, and Cu, or alloys of these metals or carbon can be used. In particular, because the conductive film 30*a*, 30*b* can be formed by the "activation" processing, which will be described later, it is preferable that the conductive film 30*a*, 30*b* are carbon films.

It is preferable that the conductive film 30*a*, 30*b* are formed in such a way as to have a sheet resistance Rs of $10^2\Omega/$ or more and $10^7\Omega/$ or less. Specifically, a film thickness showing the foregoing resistance is preferably 5 nm or more and 100 nm or less. Here, the sheet resistance value Rs is a value appearing when it is assumed that the resistance R of a film, which has a thickness of t, a width of w, and a length of 1, measured in the longitudinal direction of the film is equal to Rs (1/w), and if resistivity is assumed to be ρ, Rs=ρ/t. Further, the width W' of the conductive films 30*a*, 30*b* is preferably set narrower than the width W of the auxiliary electrodes 2, 3 (see FIG. 13A). By setting the width W wider than the width W', variations in distance between the auxiliary electrodes 2, 3 and the respective electron-emitting parts can be reduced. Although the value of width W' is not limited to a particular value, the value is preferably within a practical range of 10 μm or more to 500 μm or less.

Here, the main roles of the first auxiliary electrode 2 and the second auxiliary electrode 3 are to act as terminals for applying a voltage to the conductive films 30*a*, 30*b*, so the first auxiliary electrode 2 and the second auxiliary electrode 3 can be omitted if there is another means for applying a voltage to the gap 8.

As the substrate 1 can be used a quartz glass substrate, a blue glass substrate, a glass substrate formed of a glass substrate and silicon oxide (typically $SiO_2$) laminated on the glass substrate, or a glass substrate in which alkali component is reduced.

The first part 5 and the second part 6 are constructed of a substantially insulating material. This is because if the first part 5 and the second part 6 are substantially conductive substances, a strong electric field cannot be developed in the gap 8 and hence electrons cannot be emitted in the worst case. Moreover, if the first part 5 and the second part 6 have high conductivity, there is a possibility that when unexpected electric discharge occurs at the time of the "activation" processing or at the time of driving the electron-emitting device, a current strong enough to destroy the electron-emitting parts may flow through the gap 8. For this reason, it is important that the first part 5 and the second part 6 are substantially insulating materials.

Further, it is important that the first part 5 and the second part 6 are lower in electric conductivity (typically have higher sheet resistance value or higher resistance value) than the conductive films 30*a*, 30*b*. It is preferable that the resistivity of the material constructing the first part 5 and the second part 6 is practically $10^8$ Ωm or more. In consideration of a thickness to be described later, it is preferable that the sheet resistance value of the first part 5 and the second part 6 is practically $10^{13}\Omega/$ or more. To realize this sheet resistance value, practically, it is preferable that the first part 5 and the second part 6 are formed of material having a specific resistance of $10^8$ μm or more.

As the material of the first part 5 is selected material having higher thermal conductivity than the substrate 1 and the second part 6. Specifically, silicon nitride, alumina, aluminum nitride, tantalum pentoxide, or titanium oxide can be used as the material of the first part 5.

It suffices that the second part 6 is lower in thermal conductivity than the first part 5, for example, preferably, the second part 6 contains silicon oxide (typically, $SiO_2$). In particular, preferably, the second part 6 is mainly formed of silicon oxide. When the second part 6 is mainly formed of silicon oxide, practically, the silicon oxide contained by the second part 6 is 80 wt % or more, preferably, 90 wt % or more.

Further, depending on the material, the thicknesses (thicknesses in a Z direction in FIG. 13) of the first part 5 and the second part 6 are preferably 10 nm or more so as to effectively produce the effect of the present invention, more preferably, 100 nm or more. Moreover, the thickness does not have an upper limit from the effect but preferably is 10 μm or less in terms of the stability of the process and the thermal stress of the substrate 1.

The gap L1 in the direction (X direction) in which the first auxiliary electrode 2 and the second auxiliary electrode 3 are opposite to each other and the film thicknesses of the first and second auxiliary electrodes 2, 3 are designed as appropriate according to the applications of the electron-emitting device. For example, when the electron-emitting devices are used for an image display apparatus such as a television set to be described late, the gap L1 and the thicknesses are designed according to resolution. In particular, a high-definition television set needs to have high definition, so a pixel size needs to be reduced. For this reason, to produce sufficient brightness in a state where the size of the electron-emitting device is limited, the gap L1 and the thicknesses are designed so as to produce a sufficient electron emission current Ie.

The gap L1 in the X direction of the first auxiliary electrode 2 and the second auxiliary electrode 3 (direction in which the first auxiliary electrode 2 and the second auxiliary electrode 3 are opposite to each other) is practically set to 10 nm or more and 100 μm or less, preferably, to 50 nm or more and 5 μm or less. The auxiliary electrodes 2, 3 practically have a thickness of 100 nm or more and 10 μm or less.

As the material of the auxiliary electrodes 2, 3 can be used a conductive material such as metal and semiconductor. For example, metal such as Ni, Cr, Au, Mo, W, Pt, Ti, Al, Cu, and Pd, or alloys of these metals, and metal such as Pd, Ag, Au, $RuO_2$, Pd—Ag or metal oxide of these metals can be used. The conductive films 30*a*, 30*b* are thinner than the auxiliary electrodes 2, 3, so the auxiliary electrodes 2, 3 have sufficient higher thermal conductivity than the conductive film 30*a*, 30*b*.

Second Embodiment

The fundamental construction of a second embodiment of a modification of the electron-emitting device of the present invention will be described with reference to FIG. 1. The same parts as the parts used in FIG. 13 are denoted by the same reference numerals.

This embodiment is an embodiment in which the conductive films 30*a*, 30*b* shown in the first embodiment are constructed of electrodes 4*a*, 4*b* and conductive films 21*a*, 21*b*. In this embodiment, a first electrode 4*a* connects the auxiliary electrode 2 and the first conductive film 21*a*, and a second electrode 4*b* connects the auxiliary electrode 3 to the second conductive film 21*b*. The first electrode 4*a* and the second electrode 4*b* are opposite to each other across a second gap 7 and a boundary between the first part 5 and the second part 6 is located directly under the second gap 7. Further, like the first embodiment, the conductive films 21*a*, 21*b* are opposite to each other across the gap 8 and the boundary between the first part 5 and the second part 6 is located directly under the gap 8. It is preferable that the conductive films 21*a*, 21*b* are carbon films. Even this embodiment can produce the effect of providing excellent electron emission characteristics for a long time with stability. Further, if the electrodes 4*a*, 4*b* have higher resistance than the conductive films 21*a*, 21*b*, it is possible to further stabilize the electron emission characteristics.

Third Embodiment

Figure 3A:
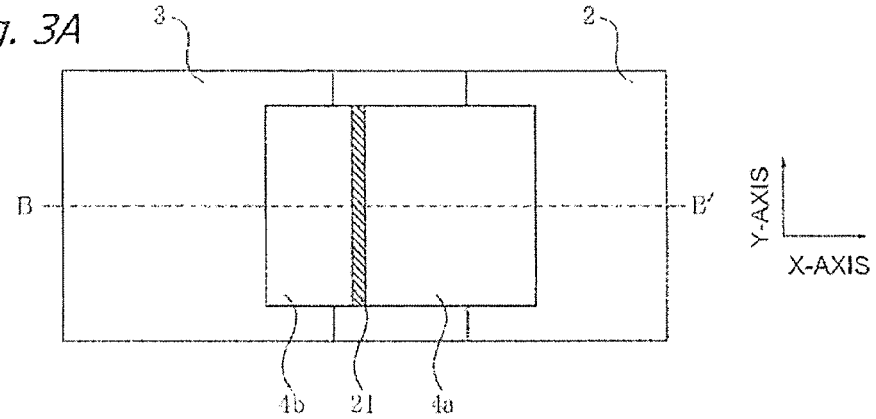
FIGS. 3A, 3B, and 3C are a plan view and cross-sectional views to schematically show another construction example of an electron-emitting device of the present invention.
Figure 3B:
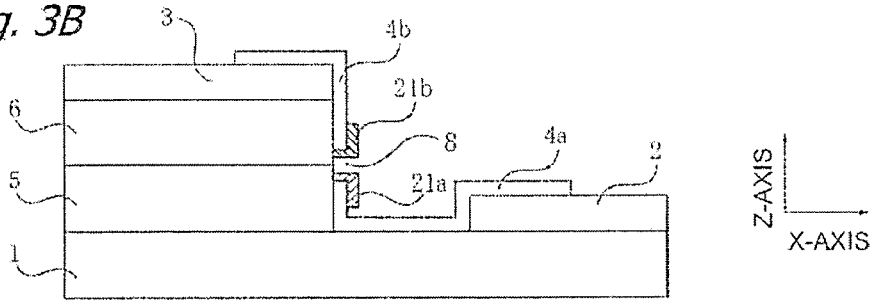

The fundamental construction of a third embodiment of a modification of the electron-emitting device of the present invention will be described with reference to FIG. 3. FIG. 3A is a schematic plan view and FIG. 3B is a cross-sectional view along a line B-B' in FIG. 3A. In FIG. 3, the same parts as the parts described in the first and second embodiments are denoted by the same reference numerals. In this embodiment, the size of L1 and the materials and sizes of the respective parts are the same as those described in the first and second embodiments.

The electron-emitting device of this embodiment shown in FIG. 3 corresponds to an electron-emitting device such that the direction in which the first conductive film 21*a* and the second conductive film 21*b* in the electron-emitting device described in the second embodiment are opposite to each other is arranged in such a way as to cross (preferably, be substantially vertical to) the surface of the substrate 1.

More specifically, the first part 5, the second part 6, and the second auxiliary electrode 3 are laminated on the substrate 1. Also in this embodiment, the base body 100 is constructed of the first part 5, the second part 6, and the substrate 1.

For this reason, the second gap 8 is arranged on the side surface (side surface of the first part 5) of a laminated body constructed of the first part 5, the second part 6, and the second auxiliary electrode 3. This embodiment is essentially the same in the other points as the second embodiment shown in FIG. 1. Moreover, even this embodiment shown in FIG. 3 can produce the effect of providing excellent electron emission characteristics for a long time with stability.

Figure 3C:
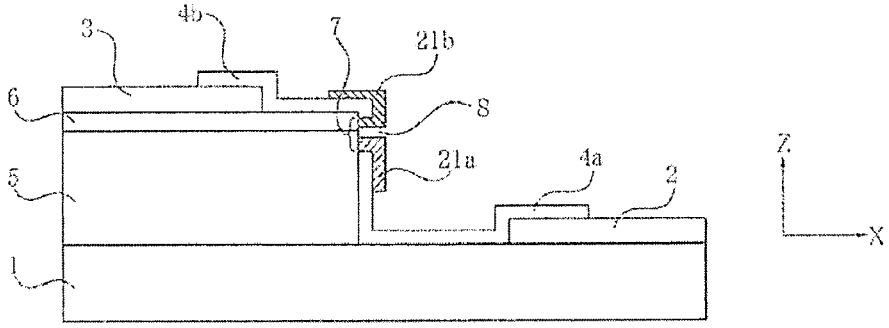

Further, as shown in FIG. 3C, the end portion of the first auxiliary electrode 2 can be separated from the end portion of the first part 5. This makes it possible to elongate the distance between the first auxiliary electrode 2 and the first carbon film 21*a*, that is, the distance between the first auxiliary electrode 2 and the second gap 8.

In this regard, in the embodiment shown here, the side surface of the laminated body on which the second gap 8 is arranged is arranged substantially vertically to the surface of the substrate 1.

In the first embodiment, the direction in which the first conductive film 30*a* and the second conductive film 30*b* are opposite to each other is the direction of the plane of the substrate 1 (X direction).

However, it is preferable from the viewpoint of improving electron emission efficiency (η) that the direction in which the first conductive film 21*a* and the second conductive film 21*b* are opposite to each other is vertical to the surface of the substrate 1.

When the electron-emitting device of the present invention is driven, as will be described with reference to FIG. 5, an anode electrode 44 is arranged apart in the Z direction from the plane of the substrate 1.

For this reason, like this embodiment, when the direction in which the first conductive film 21*a* and the second conductive film 21*b* are opposite to each other is directed to the anode electrode 44, the electron emission efficiency (η) can be enhanced. In this regard, the electron emission efficiency (η) means a value expressed by electron emission quantity (Ie)/device current (If). Here, the electron emission quantity (Ie) is current flowing into the anode electrode 44, and the device current (If) can be specified by current flowing between the first auxiliary electrode 2 and the second auxiliary electrode 3.

However, in this embodiment, the side surface of the laminated body is not limited to a surface vertical to the surface of the substrate 1. Effectively, it is preferable that the side surface of the laminated body is set to an angle of 30 degrees or more to 90 degrees or less with respect to the surface of the substrate 1.

When the electron-emitting device of the present embodiment is driven, the electric potential of the second auxiliary electrode 3 is set higher than the electric potential of the first auxiliary electrode 2. Hence, the electron-emitting device of the present embodiment is driven, as described in the first embodiment, the first conductive film 21*a* connected to the first auxiliary electrode 2 side becomes an electron emitting body (emitter). For this reason, when the second part 6 directly under the second electrode 4*b* has a highly insulating property, even if electric discharge is developed, it is possible to suppress damage to the electron emitting part.

Moreover, the structure of the base body 100 shown in this embodiment can be applied to the structure of the base body 100 of the first embodiment. That is, in this case, the first electrode 4*a* and the first conductive film 21*a* shown in FIG. 3 are replaced by the first conductive film 30*a* and the second electrode 4*b* and the second conductive film 21*b* are replaced by the second conductive film 30*b*.

Next, a method for manufacturing an electron-emitting device of the present invention will be described.

By taking the electron-emitting device of the second embodiment as an example, one embodiment of the manufacturing method of the present invention will be specifically described below with reference to FIG. 2. The manufacturing method of the present invention can be performed, for example, by the following processes 1 to 5.

(Process 1)

Figure 2A:
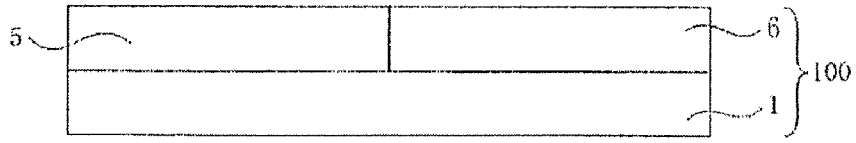
FIGS. 2A to 2E are schematic views to show the outline of a method for manufacturing an electron-emitting device of the present invention.

The substrate 1 is sufficiently cleaned, and the first part 5 and the second part 6 are formed on the substrate 1 by the use of a photolithography technology (including resist coating, exposing, developing, and etching). Then, material for forming the second part 6 is deposited by a vacuum evaporation method, a sputtering method, or a CVD method. Then, the material is lifted off by the use of a separating agent to prepare the base body 100 having the first part 5 and the second part 6 formed thereon (FIG. 2A).

At this time, it is preferable that the surface of the second part 6 and the surface of the first part 5 (that is, the surface of the base body 100) are formed in a nearly flat plane. However, if the film thickness of the conductive film 4 to be formed in a process 3 to be described later is not specially changed, the surfaces may be formed in a slightly uneven plane.

Further, here, an embodiment has been shown in which the first part 5 and the second part 6 are formed on the substrate 1. However, one or both of the first part 5 and the second part 6 may be formed on a portion of the substrate 1. Still further, as for the materials and sizes of the first part 5, the second part 6, and the substrate 1, it suffices to suitably apply the materials and sizes described in the foregoing embodiments to them.

(Process 2)

Figure 2B:
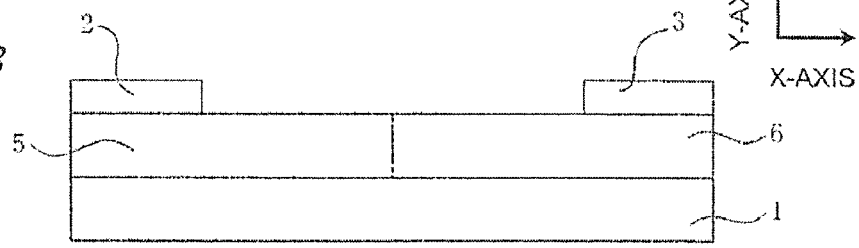

Next, material for forming the auxiliary electrodes 2, 3 is deposited by the vacuum evaporation method, the sputtering method, or the like. Then, the material is patterned by the use of the photolithography or the like to form the first auxiliary electrode 2 and the second auxiliary electrode 3 on the base body 100 (FIG. 2B).

At this time, the first auxiliary electrode 2 and the second auxiliary electrode 3 are formed in such a way that the boundary between the first part 5 and the second part 6 is located between the first auxiliary electrode 2 and the second auxiliary electrode 3. As for the material, the film thickness, the gap L1, and the width W of the auxiliary electrodes 2, 3, it suffices to apply the materials and the values described in the foregoing embodiments to them as appropriate. Here, in the present invention, the auxiliary electrodes 2, 3 can be also omitted.

(Process 3)

Figure 2C:
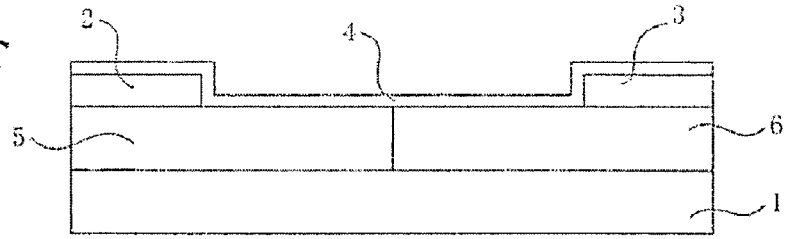

Subsequently, the conductive film 4 for connecting the first auxiliary electrode 2 and the second auxiliary electrode 3, which are formed on the base body 100, is formed (FIG. 2C). By this process 3, the conductive film 4 is formed across the first part 5 and the second part 6.

As a method for manufacturing the conductive film 4 can be employed the following method: for example, first, an organic metal solution is applied and dried to form an organic metal film; then, the organic metal film is heated and baked to form a metal compound film such as a metal film or a metal oxide film; and then, the metal compound film is patterned by lifting-off or etching to produce the conductive film 4.

As the material of the conductive film 4 can be conductive material such as metal or semiconductor. For example, metal such as Ni, Cr, Au, Mo, W, Pt, Ti, Al, Cu, or Pd, or metal compound (alloy or metal oxide) of them.

A method for coating an organic metal solution has been described here, but the method for forming the conductive film 4 is not limited to this method. The conductive film 4 can be also formed by a publicly known method, for example, the vacuum evaporation method, the sputtering method, the CVD method, a diffusion coating method, a dipping method, a spinner method, or an ink jet method.

When the "current passing forming" processing is performed in the next process, the conductive film 4 is formed so as to have a sheet resistance Rs of $10^2$ Ω/ or more and $10^7$Ω/ or less. Here, the sheet resistance Rs is a value appearing when it is assumed that the resistance R of a film, which has a thickness of t, a width of w, and a length of l, measured in the longitudinal direction of the film is equal to Rs (l/w), and if resistivity is assumed to be ρ, Rs=ρ/t. The film thickness showing the foregoing resistance value is practically 5 nm or more and 50 nm or less. Further, the width W' of the conductive film 4 (see FIG. 1) is set narrower than the widths W of the auxiliary electrodes 2, 3. The process 3 can be also replaced in order by the process 2.

(Process 4)

Subsequently, the first gap 7 is formed in the conductive film 4. A patterning method using an EB lithography method can be employed as a method for forming the gap 7. Further, a FIB (Focused Ion Beam) is directed on a portion where the gap 7 of the conductive film 4 is desired to be formed to form the gap 7 at a predetermined portion of the conductive film 4 (portion located above the boundary between first part 5 and the second part 6). In other words, the boundary between first part 5 and the second part 6 can be located directly under the gap 7 (the boundary between first part 5 and the second part 6 can be exposed in the gap 7). Further, in still other words, the boundary between the first part 5 and the second part 6 can be located between the first electrode 4*a* and the second electrode 4*b* that are arranged separately from each other.

Of course, the gap 7 can be also formed in a portion of the conductive film 4 by passing current through the conductive film 4 by the publicly known "current passing forming" processing. The current can be passed through the conductive film 4, specifically, by applying a voltage between the first auxiliary electrode 2 and the second auxiliary electrode 3. When the first auxiliary electrode 2 and the second auxiliary electrode 3 are not used, "the current passing forming" processing can be performed by applying a voltage across both ends of the conductive film 4.

However, there are cases where it is difficult to control the position of the gap 7 by "the current passing forming" processing. For this reason, when the gap 7 is formed by "the current passing forming" processing, it is preferable to make a portion of the conductive film 4 where the first gap 7 is desired to be formed have high resistance and then to perform "the current passing forming" processing.

Figure 2D:
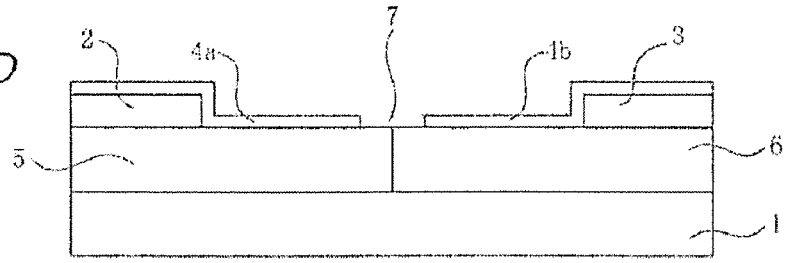

By this process, the first electrode 4*a* and the second electrode 4*b* are arranged opposite to each other in the X direction across the first gap 7 (FIG. 2D). That is, the first electrode 4*a* and the second electrode 4*b* are arranged separately from each other on the base body 100. Here, there are also cases where the first electrode 4*a* and the second electrode 4*b* are connected to each other by a small portion.

Figure 5:
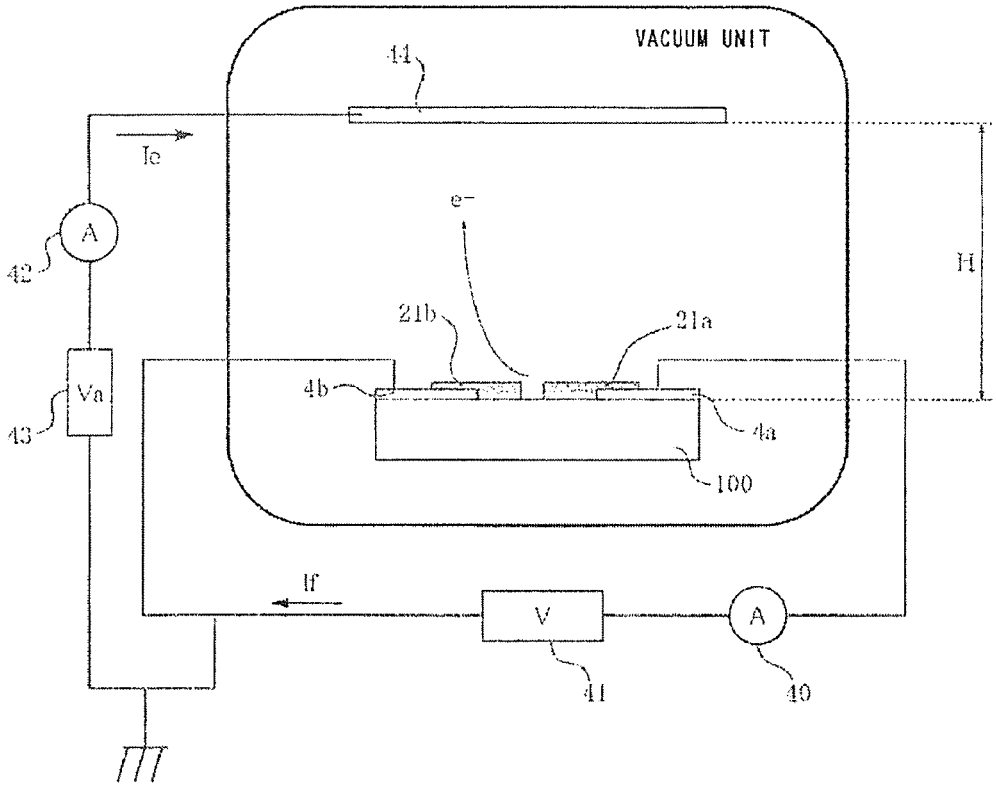
FIG. 5 is a schematic view to show one example of a vacuum unit having a measurement evaluation function of an electron-emitting device.

The base body 100 subjected to the foregoing processes 1 to 3 is put in a vacuum unit shown in FIG. 5 and the vacuum unit is evacuated to a vacuum. And then processing after the process 4 is performed.

In this regard, a measurement evaluation unit shown in FIG. 5 has the vacuum unit (vacuum chamber) and the vacuum unit is provided with devices necessary for the vacuum unit such as an exhaust pump and a vacuum meter (not shown). In the interior of the vacuum unit, various kinds of measurements and evaluations can be performed under a desired vacuum.

Further, when this measurement evaluation unit is provided with a gas introduction unit (not shown), gas containing carbon that is used in the "activation" processing to be described later can be introduced into the vacuum unit at a desired pressure. Still further, the entire vacuum unit and the base body 100 arranged in the vacuum unit can be heated by a heater (not shown).

Figure 6A:
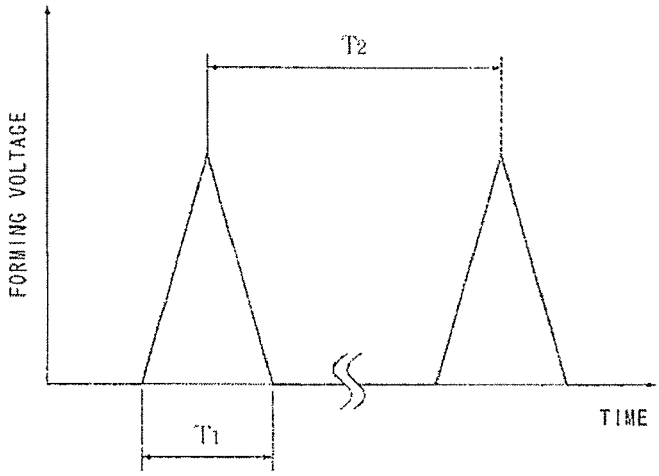
FIGS. 6A and 6B are schematic views to show one example of a pulse applied at the time of "forming" processing.

The "current passing forming" processing can be performed by repeatedly applying a pulse voltage, in which a pulse crest value is a constant voltage, across the first auxiliary electrode 2 and the second auxiliary electrode 3. Further, the "current passing forming" processing can be performed also by repeatedly applying a pulse voltage while gradually increasing its pulse crest value. An example of a pulse shape when the pulse crest value is constant is shown in FIG. 6A. In FIG. 6A, reference numerals T1 and T2 denote a pulse width and a pulse interval (quiescent time) of a voltage waveform. T1 can be set to a range from 1 μsec to 10 msec, and T2 can be set to a range from 10 μsec to 100 msec. A triangular waveform or a rectangular waveform can be used as the shape of the pulse voltage to be applied.

Figure 6B:
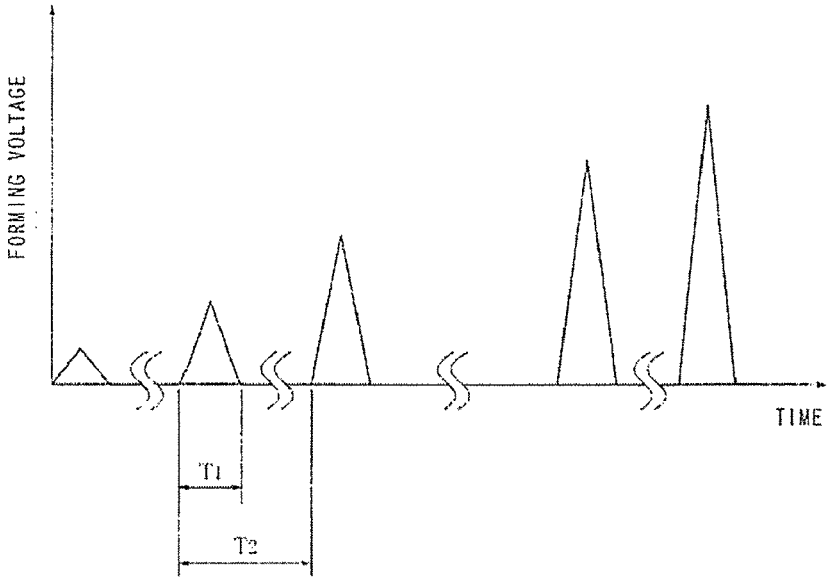

Next, an example of a pulse shape in which a pulse voltage is applied while increasing the pulse crest value is shown in FIG. 6B. In FIG. 6B, reference numerals T1 and T2 denote a pulse width and a pulse interval (quiescent time) of the voltage waveform. T1 can be set to a range from 1 μsec to 10 msec, and T2 can be set to a range from 10 μsec to 100 msec. A triangular waveform or a rectangular waveform can be used as the shape of the pulse voltage to be applied. The crest value of the applied pulse voltage is increased, for example, by a step of about 0.1 V.

In the example described above, a pulse voltage having a triangular waveform is applied across the first auxiliary electrode 2 and the second auxiliary electrode 3. However, the shape of the pulse voltage to be applied across the first auxiliary electrode 2 and the second auxiliary electrode 3 is not limited to the triangular waveform but a desired waveform such as a rectangular waveform may be used. Further, the pulse crest value, the pulse width, and the pulse interval are not limited to the foregoing values, but suitable values can be selected in accordance with the resistance value of the electron-emitting device or the like so as to form the first gap 7 in a good shape.

(Process 5)

Figure 2E:
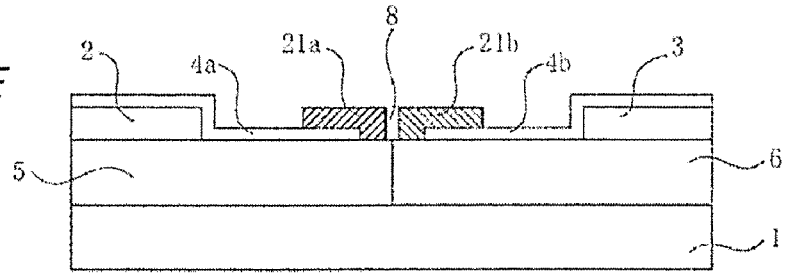

Next, the conductive films 4*a*, 4*b* are subjected to the "activation" processing (FIG. 2E).

Figure 7A:
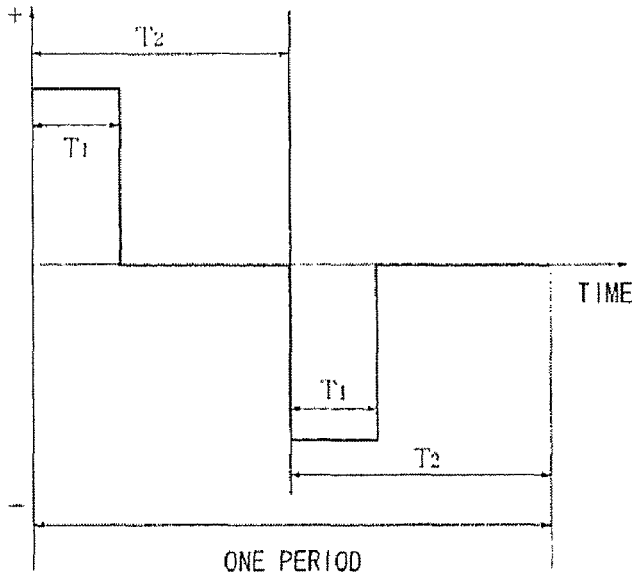
FIGS. 7A and 7B are schematic views to show one example of a pulse applied at the time of "activation" processing.
Figure 7B:
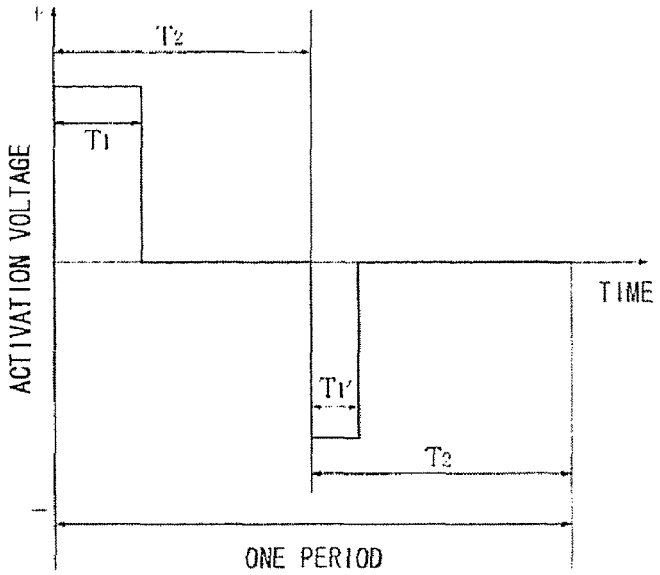

The "activation" processing is performed, for example, by introducing gas containing carbon into the vacuum unit shown in FIG. 5 and by applying a bipolar pulse voltage as shown in FIG. 7A and FIG. 7B across the auxiliary electrodes 2, 3 a plurality of times in an atmosphere containing the gas containing carbon. That is, the bipolar pulse voltage is applied across the first electrode 4*a* and the second electrode 4*b* the plurality of times in the atmosphere containing the gas containing carbon.

By this processing, a carbon film (a first carbon film 21*a* and a second carbon film 21*b*) can be formed on the base body 100 by the gas containing carbon existing in the atmosphere. Specifically, the carbon film 21*a*, 21*b* are deposited on the base body 100 between the first electrode 4*a* and the second electrode 4*b* and the first electrode 4*a* and the second electrode 4*b* near the base body 100. That is, the first carbon film 21*a* and the second carbon film 21*b* arranged separately from the first carbon film 21*a* are formed on the base body 100.

When the foregoing method is employed, the second gap 8 can be located above the boundary between the first part 5 and the second part 6, although the reason is not known in detail. In other words, the boundary between the first part 5 and the second part 6 can be located in the gap 8. Alternatively, in still other words, the boundary between the first part 5 and the second part 6 can be located between the first carbon film 21*a* and the second carbon film 21*b*.

As the gas containing carbon can be used, for example, an organic substance gas. Examples of the organic substance include a class of aliphatic hydrocarbon of alkane, alkene, and alkyne, a class of aromatic hydrocarbon, a class of alcohol, a class of aldehyde, a class of ketone, a class of amine, and a class of organic acid such as phenolic acid, carboxylic acid, and sulfonic acid. Specifically, saturated hydrocarbon expressed by a composition formula of $C_nH_{2n+2}$ such as methane, ethane, and propane, and unsaturated hydrocarbon expressed by a composition formula of $C_nH_{2n}$ such as ethylene, propylene can be used. Further, benzene, toluene, methanol, ethanol, formaldehyde, acetaldehyde, acetone, methyl ethyl ketone, methyl amine, ethyl amine, phenol, formic acid, acetic acid, propionic acid can be also used. In particular, trinitryl is preferably used.

The waveform of the bipolar pulse voltage to be applied during the "activation" processing is a waveform in which the relationship between the electric potential of the auxiliary electrode 2 or the first electrode 4*a* and the electric potential of the auxiliary electrode 3 or the second electrode 4*b* is reversed at predetermined timings or at predetermined periods (see FIG. 7A, 7B). It is preferable that the relationship of the electric potential is alternately reversed, but the present invention is not limited to the alternately reversed waveform.

The application of the bipolar pulse voltage can be realized, for example, in the following manner. That is, a pulse voltage for making the electric potential of the auxiliary electrode 2 or the first electrode 4*a* higher than the electric potential of the auxiliary electrode 3 or the second electrode 4*b* is applied. Then, a pulse voltage for making the electric potential of the auxiliary electrode 2 or the first electrode 4*a* lower than the electric potential of the auxiliary electrode 3 or the second electrode 4*b* is applied. It is preferable that this operation is repeatedly performed. Here, it can be freely set which of the electric potential of the auxiliary electrode 2 or the first electrode 4*a* and the electric potential of the auxiliary electrode 3 or the second electrode 4*b* is first made a higher electric potential.

It is preferable that a maximum voltage value (absolute value) to be applied is selected as appropriate within a range of from 10 V to 25 V.

In FIG. 7A, reference numeral T1 denotes the pulse width of a pulse voltage to be applied and T2 denotes a pulse interval. In this example is shown a case where the absolute values of positive and negative voltage values are equal to each other, but there are also cases where the absolute values of positive and negative voltage values are different from each other. Further, in FIG. 7B, reference numeral T1 denotes the pulse width of a pulse voltage of a positive voltage value and T1' denotes the pulse width of a pulse voltage of a negative voltage value. Reference numeral T2 denotes a pulse interval. In this example is shown a case where T1>T1' and where the absolute values of positive and negative voltage values are equal to each other, but there are also cases where the absolute values of positive and negative voltage values are different from each other. It is preferable that the "activation" processing is finished after an increase in the device current (If) becomes gentle.

Further, even if which of waveforms shown in FIG. 7 is used, the "activation" processing is performed until an increase in the device current (If) becomes gentle, whereby the gap 8 can be formed above the boundary between the first part 5 and the second part 6 as shown in FIG. 2E.

Figure 1A:
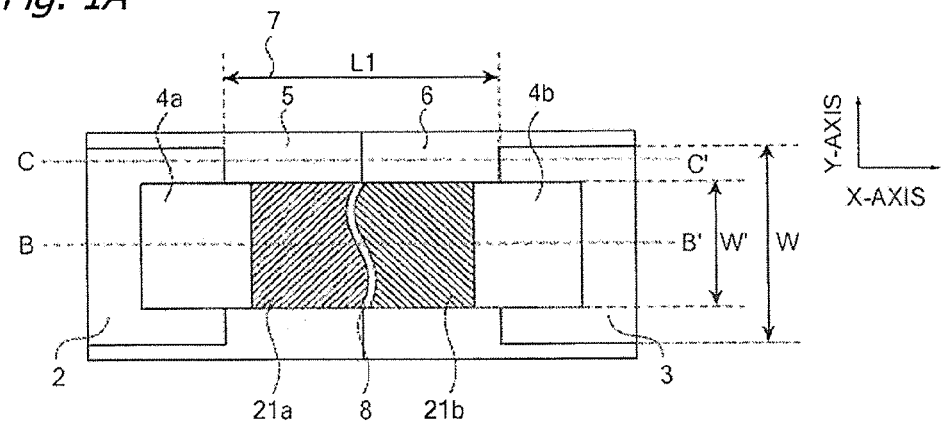
FIGS. 1A, 1B, and 1C are a plan view and cross-sectional views to schematically show a construction example of an electron-emitting device of the present invention.
Figure 1B:
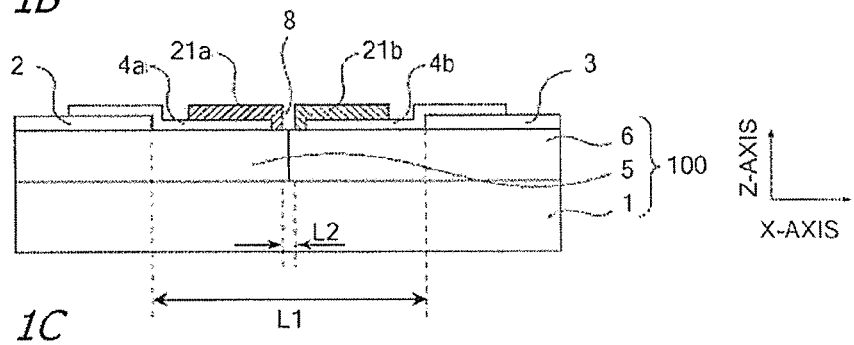
Figure 1C:
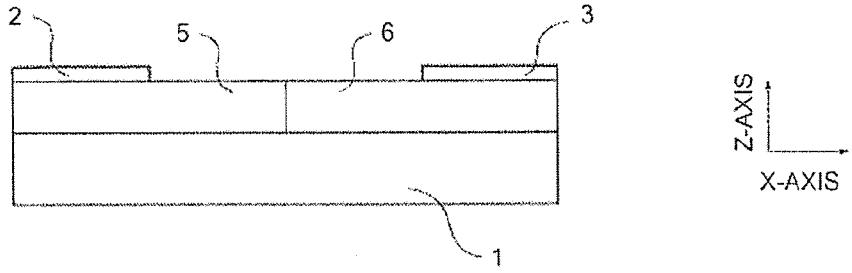

The electron-emitting device shown in FIG. 1 can be formed by the foregoing processes 1 to 5.

When the electron-emitting device of the embodiment shown in FIG. 13 is formed, the foregoing process 4 is not performed. The gap L1 between the first auxiliary electrode 2 and the second auxiliary electrode 3 in the process 3 is set to 50 nm or more and 5 μm or less and then the "activation" processing described in the process 5 is performed. With this, the carbon films 30*a*, 30*b* can be formed and the gap 8 can be formed above the boundary between the first part 5 and the second part 6 (the boundary between the first part 5 and the second part 6 is formed in the gap 8).

The manufactured electron-emitting device is preferably subjected to "stabilizing" processing that is heating processing in a vacuum before the electron-emitting device is driven (before an electron beam is directed upon a light-emitting substance when the electron-emitting device is applied to the image display apparatus).

It is preferable that extra carbon and organic substance attached to the surface or other portion of the base body 100 by the foregoing "activation" processing are removed by the "stabilizing" processing.

Specifically, the extra carbon and the organic substance are exhausted in the vacuum unit. It is desirable to remove the organic substance in the vacuum unit as much as possible. Preferably, the partial pressure of the organic substance is reduced to $1\times10^{-8}$ Pa or less. Further, the total pressure of the atmosphere in the vacuum chamber including other gas except for the organic substance is preferably reduced to $3\times10^{-6}$ Pa or less.

It is preferable that the atmosphere when the "stabilizing" processing is finished is kept also when the electron-emitting device is driven after the "stabilizing" processing is performed, but the atmosphere when the electron-emitting device is driven after the "stabilizing" processing is performed is not limited to this atmosphere. If the organic substance is sufficiently removed, even if the pressure itself is slightly increased, sufficiently stable characteristics can be kept. The electron-emitting device of the present invention can be formed in the foregoing processes.

Further, the electron-emitting device of the embodiment shown in FIG. 3B can be formed, for example, in the following manner. One example will be described with reference to FIG. 4.

First, a material layer constructing the first part 5 and a material layer constructing the second part 6 are laminated in this order on the substrate 1 described in the foregoing process 1. These material layers can be deposited on the substrate 1 by the vacuum evaporation method, the sputtering method, or the CVD method. Next, a material layer constructing the second auxiliary electrode 3 is deposited on the material layer constructing the second part 6 by the vacuum evaporation method, the sputtering method, or the CVD method (see FIG. 4A).

Figure 4A:
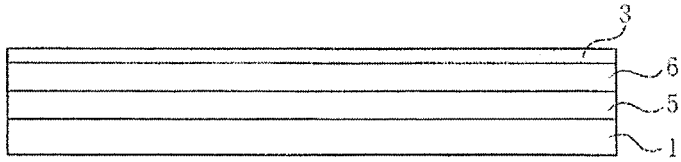
FIGS. 4A to 4F are schematic views to show the outline of a method for manufacturing an electron-emitting device of the present invention.
Figure 4B:
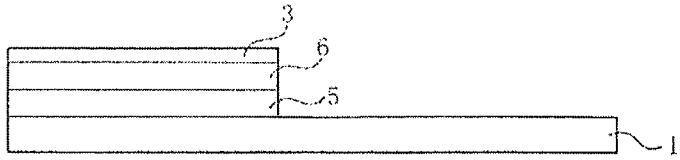

Then, a laminated body having a stepped shape is formed on a portion of the surface of the substrate 1 by publicly known patterning method such as a photolithography technology (FIG. 4B).

Figure 4C:
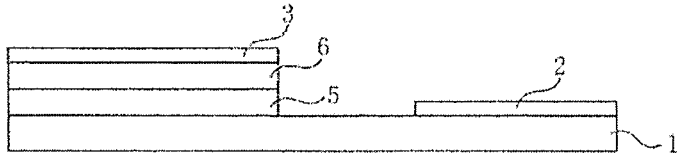

Next, the first auxiliary electrode 2 is formed on the substrate 1 (FIG. 4C).

Figure 4D:
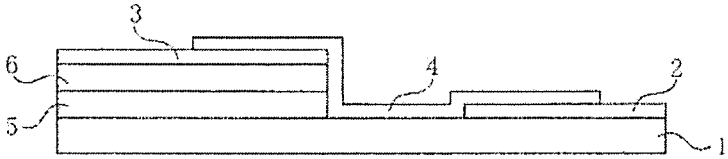
Figure 4E:
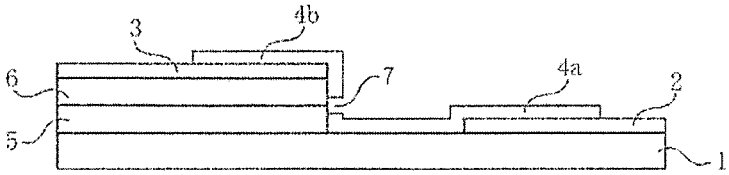
Figure 4F:
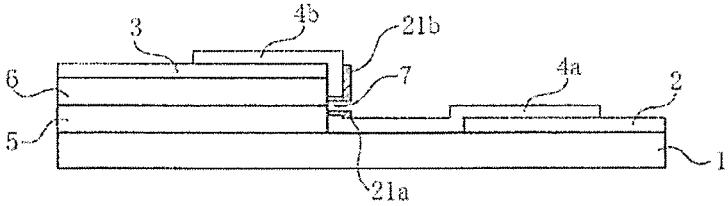

Subsequently, the conductive film 4 is formed by the same process 3 described above so as to cover the side surface of the laminated body and to connect the first auxiliary electrode 2 and the second auxiliary electrode 3 (FIG. 4D).

Then, the same processing as in the processes 4 and 5 described above is performed (FIGS. 4E, 4F).

In this manner, the electron-emitting device of the embodiment shown in FIG. 3B can be formed. Moreover, the embodiment shown in FIG. 3C is different from the embodiment shown in FIG. 3B only in that the end portion of the second auxiliary electrode 3 is shifted in position, so the embodiment shown in FIG. 3C can be formed by performing the patterning process in addition to the foregoing forming method.

In this regard, the method for manufacturing the electron-emitting device of the foregoing embodiment shown here is only one example. It is not intended to limit the electron-emitting devices of the foregoing first and second embodiments to the electron-emitting device manufactured by these manufacturing methods.

Figure 8:
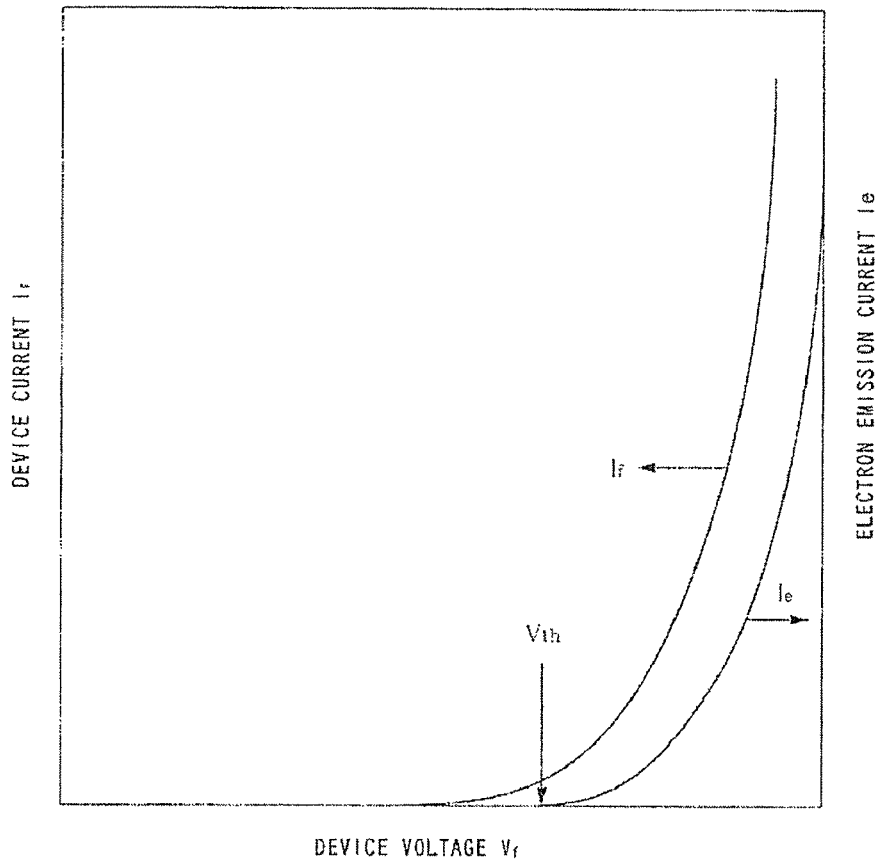
FIG. 8 is a schematic view to show electron emission characteristics of an electron-emitting device of the present invention.

Next, the fundamental characteristics of the foregoing electron-emitting device of the present invention will be described with reference to FIG. 8. A typical example of the relationship between the electron emission current Ie and the device current If of the electron-emitting device of the present invention and a device voltage Vf to be applied across the auxiliary electrodes 2, 3 is shown in FIG. 8, the electron emission current Ie and the device current If being measured by the measurement evaluation unit shown in FIG. 5.

Here, the electron emission current Ie is extremely smaller than the device current If, and they are shown by respective arbitrary units. As is clear from FIG. 8, the electron-emitting device of the present invention has three properties relating to the electron emission current Ie.

First, when a device voltage of a specified voltage or more (which is called threshold voltage; Vth in FIG. 8) is applied to the electron-emitting device of the present invention, the electron emission current Ie is rapidly increased, whereas the device voltage is the threshold or less, the electron emission current Ie is hardly detected. That is, the electron-emitting device of the present invention is a non-linear device having a definite threshold voltage Vth to the electron emission current Ie.

Secondly, since the electron emission current Ie depends on the device voltage Vf, the electron emission current Ie can be controlled by the device voltage Vf.

Thirdly, the emitted electric charges captured by the anode electrode 44 depend on the time during which the device voltage Vf is applied to the electron-emitting device. In other words, the quantity of electric charges captured by the anode electrode 44 can be controlled by the time during which the device voltage Vf is applied to the electron-emitting device.

The electron emission characteristics can be easily controlled according to an input signal by the use of the foregoing characteristics of to the electron-emitting device.

Next, the application of the electron-emitting device of the present invention shown in the first and second embodiments will be described below.

An electron source and an image display apparatus such as a flat panel type television set can be constructed by arraying a plurality of electron-emitting devices of the present invention on the substrate.

A pattern of arraying the electron-emitting devices on the substrate includes, for example, a matrix type array. In this pattern of array, the foregoing first auxiliary electrode 2 is electrically connected to one of m lines of X-direction wiring arrayed on the substrate, whereas the foregoing second auxiliary electrode 3 is electrically connected to one of n lines of Y-direction wiring arrayed on the substrate. Here, both of m and n are positive integers.

Next, the construction of an electron source substrate of this matrix type array will be described with reference to FIG. 9.

The m lines of X-direction wiring 72 include Dx1, Dx2, . . . , and Dxm and are formed on the insulating substrate 71 by the vacuum evaporation method, a printing method, or the sputtering method. The m lines of X-direction wiring 72 are formed of conductive material such as metal. The n lines of Y-direction wiring 73 include Dy1, Dy2, . . . , and Dyn and can be formed by the same method and of the same material as the X-direction wiring 72. An insulating layer (not shown) is arranged between (at the intersections of) the m lines of X-direction wiring 72 and the n lines of Y-direction wiring 73. The insulating layer can be formed by the vacuum evaporation method, the printing method, or the sputtering method.

Further, scanning signal application means (not shown) for applying a scanning signal is electrically connected to the X-direction wiring 72, whereas modulation signal production means (not shown) for applying a modulation signal for modulating an electron emitted from the selected electron-emitting device 74 in synchronization with the scanning signal is electrically connected to the Y-direction wiring 73. The driving voltage Vf to be applied to each electron-emitting device is supplied as a difference voltage between the scanning signal and the modulation signal that are to be applied to the electron-emitting device.

Figure 10:
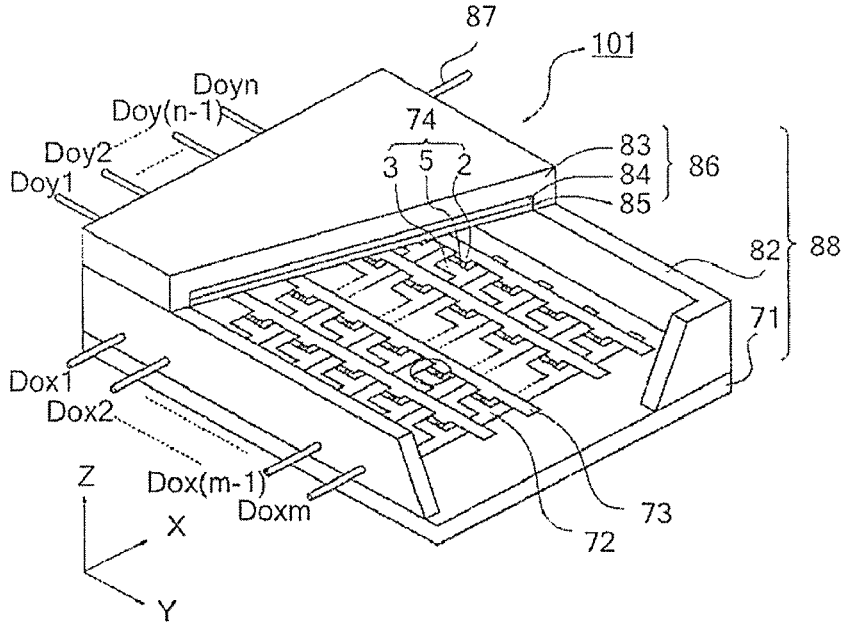
FIG. 10 is a schematic view to illustrate the construction of one example of an image display apparatus of the present invention.

Next, one example of an electron source and an image display apparatus that use the electron source substrate of the matrix type array described above will be described with reference to FIG. 10 and FIG. 11. FIG. 10 is a fundamental construction diagram of an enclosure (display panel) 88 constructing an image display apparatus, and FIG. 11 is a schematic diagram to show the construction of a luminescent film.

In FIG. 10, a plurality of electron-emitting devices 74 of the present invention are arrayed in the shape of a matrix on the electron source substrate (rear plate) 71. A face plate 86 is a plate such that a luminescent film 84 and a conductive film 85 are formed on the inner surface of a transparent substrate 83 such as glass. A support frame 82 is arranged between the face plate 86 and the rear plate 71. The rear plate 71, the support frame 82, and the face plate 86 are joined to each other by applying an adhesive such as frit glass or indium to the joins of them. The enclosure (display panel) 88 is constructed of this joined structural body. Here, the foregoing conductive film 85 is a member corresponding to the anode 44 described with reference to FIG. 5.

The enclosure 88 can be constructed of the face plate 86, the support frame 82, and the rear plate 71. Further, the enclosure 88 having sufficient strength against the atmospheric pressure can be constructed by placing a support body (not shown) called a spacer between the face plate 86 and the rear plate 71.

Figure 11A:
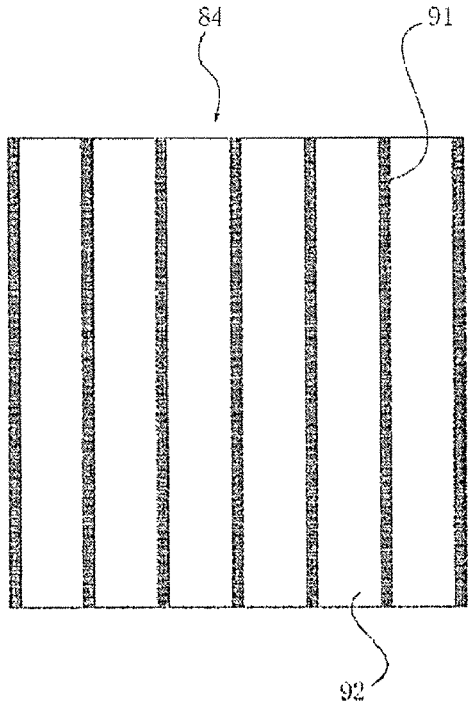
FIGS. 11A and 11B are schematic views to show a luminescent film.
Figure 11B:
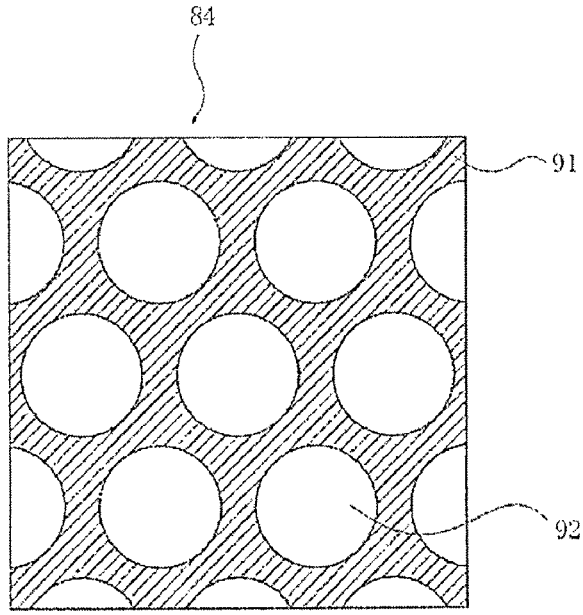

FIGS. 11A and 11B are specific construction examples of the luminescent film 84 shown in FIG. 10. In the case of constructing a monochrome image display apparatus, the luminescent film 84 is consisted of only a monochromatic fluorescent substance 92. In the case of constructing a color image display apparatus, the luminescent film 84 includes at least fluorescent substances 92 of three primary colors of red, green, and blue, and light absorption members 91 arranged between the respective colors. A black member can be preferably used as the light absorption member 91. FIG. 11A shows a pattern in which the light absorption members 91 are arranged in the shape of stripes. FIG. 11B shows a pattern in which the light absorption members 91 are arranged in the shape of a matrix. Generally, the pattern shown in FIG. 11A is called "black stripes" and the pattern shown in FIG. 11B is called "black matrix". The object of arranging the light absorption members 91 is to prevent color mixture in color separation portions, which are located between the respective fluorescent substances 92 of three primary colors required in the case of color display, from standing out and to prevent the luminescent film 84 from reflecting external light to decrease contrast. As for the material of the light absorption member 91, not only material having graphite as a main component, which is usually often used, but also any material that hardly transmits and reflects light can be used. Further, the material of the light absorption member 91 may be conductive material or insulating material.

Further, a conductive film 85 called "metal back" or the like is disposed on the inner surface side (the electron-emitting device 74 side) of the luminescent film 84. One object of disposing the conductive film 85 is to surface reflect light, which is to be directed to the electron-emitting device 74 from the fluorescent substance 92, to the face plate 86 to enhance brightness. Further, another object of disposing the conductive film 85 is to make the conductive film 85 act as an anode for applying an electron beam acceleration voltage and to prevent negative ions generated in the enclosure 88 from colliding with the fluorescent substance to cause damage to the fluorescent substance.

It is preferable that the conductive film 85 is formed of an aluminum film. The conductive film 85 can be manufactured in the following manner: the luminescent film 84 is manufactured; then, processing of smoothing the surface of the luminescent film 84 is performed (this processing is usually referred to as "filming" processing); and then aluminum Al is deposited by the vacuum evaporation method or the like.

The face plate 86 may have a transparent electrode (not shown), which is made of ITO or the like, formed between the luminescent film 84 and the transparent substrate 83 so as to further enhance the conduction of the luminescent film 84.

Figure 9:
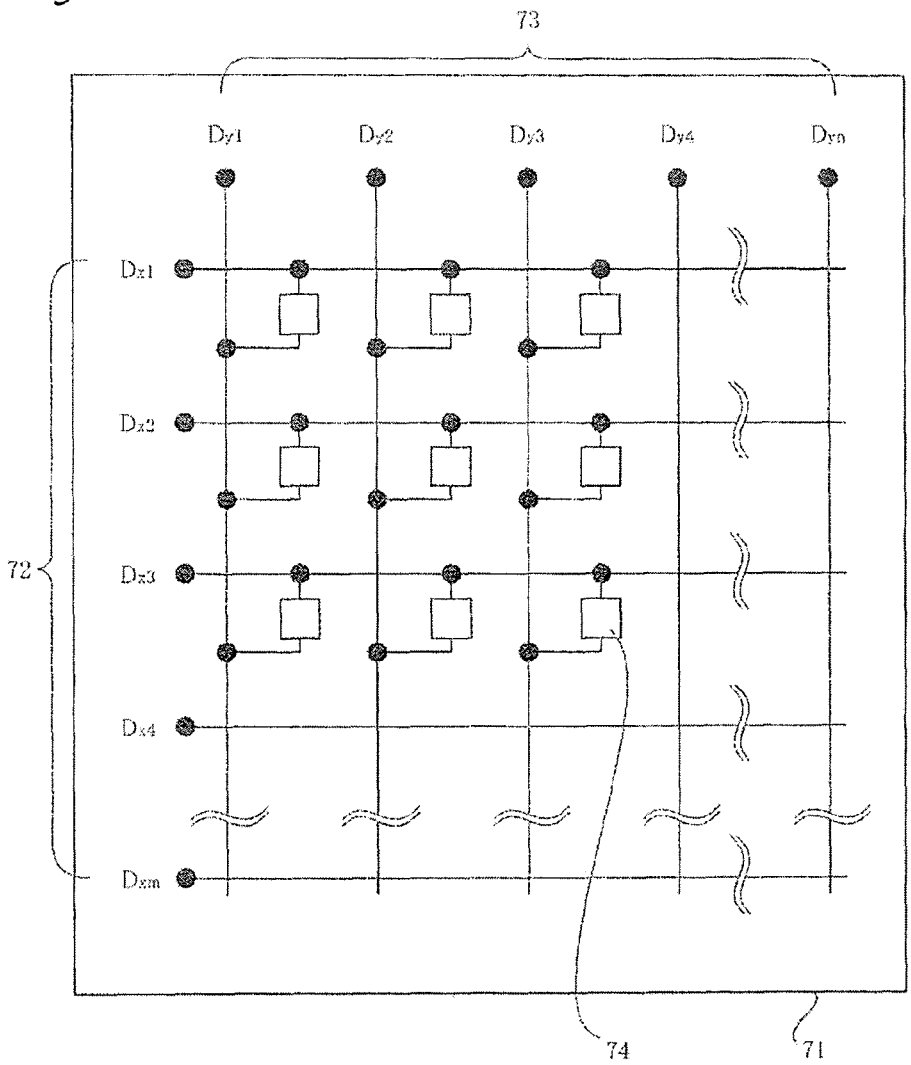
FIG. 9 is a schematic view to illustrate an electron source substrate using electron-emitting devices of the present invention.

The respective electron-emitting devices 74 in the enclosure 88 are connected to the X-direction wiring 72 and the Y-direction wiring 73, as shown in FIG. 9. For this reason, by applying a voltage to the respective electron-emitting devices 74 through the terminals Dox1 to Doxm, Doy1 to Doyn, which are connected to the electron-emitting devices 74, it is possible to emit electrons from the desired electron-emitting devices 74. At this time, a voltage that is 5 kV or more and 30 kV or less, preferably, 10 kV or more and 25 kV or less is applied to the conductive film 85 through a high-voltage terminal 87. Here, the gap between the face plate 86 and the substrate 71 is set to 1 mm to 5 mm, preferably, not smaller than 1 mm and not larger than 3 mm. In this manner, the electrons emitted from the selected electron-emitting devices pass through the metal back 85 and collide with the luminescent film 84 to excite the fluorescent substance 92 to emit light, thereby displaying an image.

In this regard, in the foregoing construction, the detailed contents such as material and size of the respective parts are not limited to the contents described above but may be modified as appropriate according to the object.

Further, an information display/reproducing apparatus can be constructed by the use of the enclosure (display panel) 88 of the present invention described with reference to FIG. 10.

Specifically, the information display/reproducing apparatus includes a receiving unit and a tuner for tuning a received signal and outputs a signal included in a tuned signal to the display panel 88 to display or reproduce the signal on a screen. The receiving unit can receive a broadcast signal such as television broadcast signal. The signal included in the tuned signal designates at least one of image information, character information, and voice information. Here, it can be said that the "screen" corresponds to the luminescent film 84 in the display panel 88 shown in FIG. 10. With this construction, the information display/reproducing apparatus such as a television set can be constructed. Of course, when the broadcast signal is encoded, the information display/reproducing apparatus of the present invention can include also a decoder. Further, a voice signal is outputted to voice reproduction means such as a speaker provided separately and is reproduced in synchronization with the image information and the character information displayed on the display panel 88.

Furthermore, a method for outputting image information and character information to the display panel 88 to display and/or reproduce the information on the screen can be performed, for example, in the following manner. First, image signals corresponding to the respective pixels of the display panel 88 are produced from the received image information and character information. Then, the produced image signals are inputted to a drive circuit C12 of a display panel C11. Then, a voltage to be applied to the respective electron-emitting devices in the display panel 88 is controlled by the drive circuit C12 based on the image signals inputted to the drive circuit C12 to display an image.

Figure 12:
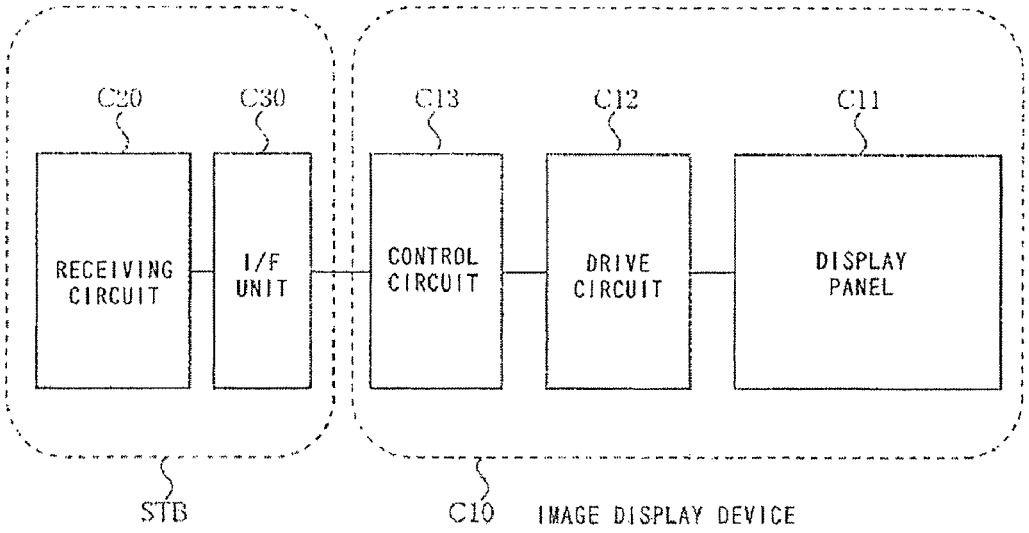
FIG. 12 is a block diagram of a television apparatus of the present invention.

FIG. 12 is a block diagram of a television set according to the present invention. A receiving circuit C20 of a receiver includes a tuner, a decoder, and the like, and receives a television signal such as satellite broadcast and terrestrial waves, data broadcast through a network, and the like, and outputs decoded image data to an IF unit (interface unit) C30. The I/F unit C30 converts image data to a display format of the display apparatus and outputs the image data to a display panel C11. An image display apparatus C10 includes the display panel C11, a drive circuit C12, and a control circuit C13. The control circuit C13 subjects the inputted image data to image processing of correction processing or the like suitable for the display panel and outputs the image data and various control signals to the drive circuit C12. The drive circuit C12 outputs a driving signal to the wiring (see Dox1 to Doxm, Doy1 to Doyn in FIG. 10) of the display panel C11 based on the inputted image data, whereby a television image is displayed. The receiving circuit C20 and the I/F unit C30 may be housed as a set top box (STB) in a box separate from the image display apparatus 10 or may be housed in the same box as the image display apparatus 10.

Further, the interface unit C30 can be constructed so as to be connected to an image recording device and an image output device such as a printer, a digital video camera, a digital camera, a hard disk drive (HDD), and a digital video disk (DVD). With this construction, an image recorded in the image recording device can be also displayed on the display panel C11. Moreover, an information reproducing apparatus (or television set) that can process the image displayed on the display panel C11, if necessary, and can output the image to the image output device can be also constructed.

The construction of the information reproducing apparatus described above is only one example and can be variously modified based on the technology philosophy of the present invention. Moreover, when the information reproducing apparatus of the present invention is connected to a teleconference system and a computer system, various information reproducing apparatuses can be constructed.

Hereinafter, the present invention will be described in more detail by examples.

Example 1

In this example will be shown an example in which the electron-emitting device described in the first embodiment was manufactured. The construction of the electron-emitting device of this example is the same as that in FIG. 1. The fundamental construction of an electron-emitting device of this example and a method for manufacturing the electron-emitting device will be described below with reference to FIG. 1 and FIG. 2.

(Process-a)

First, a photoresist layer having an opening corresponding to the pattern of a second part 6 was formed on a cleaned quartz substrate 1. Then, the depressed portion of a pattern corresponding to the second part 6 was formed on the surface of the substrate 1 by a dry etching method. Five substrates 1 were prepared in this manner.

Then, $Si_3N_4$ was deposited in the depressed portion corresponding to the second part 6 of each of the substrates 1. $Si_3N_4$ was formed by a plasma CVD method. In this example, a first part 5 was formed of quartz.

At the same time, a quartz substrate to be used for measuring resistivity and thermal conductivity was prepared and the foregoing material was deposited on this quartz substrate in the same way as the foregoing method, and then the resistivity and thermal conductivity of the materials were measured. The measurement results were as follows.

The resistivity of $Si_3N_4$ at room temperature was $1\times10^{13}$ Ωm and the thermal conductivity of $Si_3N_4$ at room temperature was 25 W/m·k. The resistivity and thermal conductivity of the quartz substrate 1 were $1\times10^{14}$ Ωm or more and 1.4 W/m·k.

The foregoing material was deposited in such a way that the surfaces of the second part 6 and the first part 5 were made nearly flat.

Next, the photoresist pattern was dissolved by an organic solvent to lift off the film deposited on the photoresist to produce a base body 100 in which the second part 6 and the first part 5 were arranged adjacently to each other (FIG. 2A).

Further, a substrate having the first part 5 and the second part 6 not formed thereon (that is, only quartz substrate 1) was prepared as a Comparative example 1. Still further, a substrate 1 in which $Si_3N_4$ was deposited on the surface of a quartz substrate 1 without being patterned (in this case, the second part 6 was formed on the whole surface of the base body) was also prepared as a Comparative example 1'.

(Process-b)

Next, the auxiliary electrodes 2, 3 were formed of Ti and Pt on each of the base bodies 100 of this example and the comparative examples, the Pt being formed on the Ti. The gap L1 was set to 20 μm.

Here, the boundary between the first part 5 and the second part 6 was formed nearly in the center between the auxiliary electrodes 2, 3. The widths W (see FIG. 1) of the auxiliary electrodes 2, 3 were set to 500 respectively (FIG. 2B).

(Process-c)

Subsequently, while the respective base bodies 100 subjected to the process-a and the process-b were rotated, they were coated with an organic palladium compound solution and then were heated and baked. The conductive films 4, each of which had Pd as a main element, were formed in this manner. Subsequently, the conductive films 4 were patterned, thereby being formed in such a way as to connect the first auxiliary electrodes 2 and the second auxiliary electrodes 3 (FIG. 2C). The formed conductive films 4 had a sheet resistance Rs of $1\times10^4\Omega/$ and had a thickness of 10 nm.

(Process-d)

Next, the respective base bodies 100 subjected to the foregoing processes from the process—a to the process-c were put in the vacuum chamber. Then, a FIB was continuously directed upon the boundary between the first part 5 and the second part 6 to form a first gap 7 in the conductive film 4, whereby electrodes 4*a*, 4*b* were formed (FIG. 2D).

(Process-e)

Subsequently, "activation" processing was performed. Specifically, trinitryl was introduced into the vacuum unit. Then, a pulse voltage of the waveform shown in FIG. 7A was applied across the auxiliary electrodes 2, 3 under following conditions: a maximum voltage was ±20V; T1 was 1 msec; and T2 was 10 msec. After the "activation" processing was started and it was recognized that the device current If started to increase gently, applying the pulse voltage was stopped to finish the "activation" processing. As a result, the carbon films 21*a*, 21*b* were formed (FIG. 2E). The boundary between the first part 5 and the second part 6 was located in and along the gap 8 between the first carbon film 21*a* and the second carbon film 21*b*. The electron-emitting device was formed in the processes described above.

In this manner, the respective base bodies 100 having the second part 6 formed of $Si_3N_4$ and the respective base bodies 100 formed as the Comparative example 1 and the Comparative example 1' were subjected to the same processes of the process-b to the process-e. Further, ten electron-emitting devices were formed on each of the base bodies 100 by the same method.

Further, in this example, the resistivity of each of the materials used for the second part 6 was $10^8$ Ωm or more, so an electric discharge causing large damage was not developed during the "activation" processing.

(Process-f)

Next, the respective electron-emitting devices were subjected to the "stabilization" processing. Specifically, the vacuum unit and the electron-emitting devices were heated by a heater and the vacuum unit was kept evacuated with the temperature held at about 250° C. Heating the vacuum unit by the heater was stopped after 20 hours and then the vacuum unit was returned to room temperature, whereby pressure in the vacuum unit reached about $1\times10^{-8}$ Pa.

Subsequently, the electron emission current Ie and the brightness of each electron-emitting device were measured by the measurement unit shown in FIG. 5.

The distance H between the anode electrode 44 and the electron-emitting device was made 4 mm and an electric potential 1 kV was placed to the anode electrode 44 by a high-voltage power source 43. In this state, a rectangular pulse voltage having a crest value of 17 V was applied between the auxiliary electrodes 2, 3 by the use of the power source 41 so as to make the electric potential of the first auxiliary electrode 2 lower than the electric potential of the second auxiliary electrode 3. Then, the device current If and the electron emission current Ie of the electron-emitting device of this example and those of the Comparative example 1 were measured by an ampere meter 40 and an ampere meter 42.

A stable electron emission current Ie could not be measured for the electron-emitting device of the Comparative example 1'. It is thought that this is because the "activation" processing was used for the manufacturing process whereas silicon oxide was not used directly below the gap 8 for the electron-emitting device of the Comparative example 1'. That is, it is estimated that because the electron-emitting device of the Comparative example 1' could not be subjected to the sufficient "activation" processing, a stable electron emission current Ie could not be measured.

Table 1 shows a comparison of electron emission current, electron emission efficiency, and drive time that passed until the electron emission current decreased one-half between the electron-emitting device of this Example 1 and the electron-emitting device of the Comparative example 1 with reference to the values of the electron-emitting device of the Comparative example 1. As shown in Table 1, the electron-emitting device according to the present invention could keep excellent electron emission characteristics for a long time. In this regard, when the characteristics of the electron-emitting device of this Example 1 were evaluated in the same way with the electric potential of the first auxiliary electrode 2 made higher than the electric potential of the second auxiliary electrode 3, all of the electron emission current, the electron emission efficiency, and the drive time that passed until the electron emission current decreased one-half decreased.

TABLE 1

| | Electron emission current | Electron emission efficiency | Time to decrease by half |
|---|---|---|---|
| Example 1 | 1.2 | 1 | 1.5 |
| Comparative example 1 | 1 | 1 | 1 |

Example 2

In this example will be shown an example in which the electron-emitting device described in the second embodiment was manufactured. The fundamental construction of the electron-emitting device according to this example is the same as shown in FIG. 3B. A method for manufacturing an electron-emitting device of this example will be described below with reference to FIG. 3 and FIG. 4.

(Process-a)

First, five cleaned quartz substrate 1 were prepared. Then, $Si_3N_4$ was deposited as material for forming the first part 5 on each of the substrates 1. $Si_3N_4$ was formed by the plasma CVD method. At the same time, the foregoing material was deposited also on another substrate to be used for measuring resistivity and thermal conductivity, and then the resistivity and thermal conductivity of the materials were measured. The measurement values were the same as those of the Example 1. Then, silicon oxide ($SiO_2$) was deposited as material for forming the second part 6 on all of the substrates 1 by the plasma CVD method. At the same time, $SiO_2$ was deposited also on a substrate to be used for measuring resistivity and thermal conductivity, and then the resistivity and thermal conductivity of the materials were measured. The measurement values were the same as those of the Comparative example 1.

Further, Ti and Pt were deposited in this order in a thickness of 5 nm and in a thickness of 45 nm as materials for forming the auxiliary electrode 3 on the second part 6 (see FIG. 4A).

Thereafter, the substrate was coated with photoresist while it was spun and then was exposed to a mask pattern and was developed. Then, the substrate was subjected to dry etching, whereby a laminated body constructed of the first part 5 and the second part 6 and the second auxiliary electrode 3 arranged on the laminated body were formed (see FIG. 4B).

Next, the substrate had the photoresist removed and then was again coated with photoresist while it was spun, and then was exposed to a mask pattern and then developed, whereby the photoresist having an opening corresponding to the pattern of the first auxiliary electrode 2 was formed. Subsequently, Ti and Pt were further deposited in sequence in a thickness of 5 nm and in a thickness of 45 nm in the opening. Then, the photoresist was lifted off to form the first auxiliary electrode 2 (see FIG. 4C).

The widths W of the auxiliary electrode 3 and the auxiliary electrode 2 were made 500 μm, respectively. The film thickness of the second part 6 was made 50 nm and the film thickness of the first part 5 was made 500 nm.

Further, there was prepared also a substrate 1 having the second part 6 not formed thereon and having only a $SiO_2$ layer (first part) formed between the surface of the substrate 1 and the second auxiliary electrode 3 (Comparative example 2). Still further, there was prepared also a substrate 1 having the first part 5 not formed thereon and having only a $Si_3N_4$ layer (second part) formed between the surface of the substrate 1 and the first auxiliary electrode 2 (Comparative example 2').

As for the subsequent processes, the substrates were subjected to the same processes as the process-c to process-f in the Example 1, whereby the electron-emitting devices were formed. Just as with the Example 1, also in this example, ten electron-emitting devices were formed on each of the substrates.

Further, also in this example, the resistivity of the foregoing material used for forming the second part 6 was $10^8$ Ωm or more and hence large electric discharge was not developed during the "activation" processing.

Subsequently, the electron emission currents Ie and the brightness of the respective electron-emitting devices were measured by the use of the measurement unit shown in FIG. 5.

The distance H between the anode electrode 44 and the electron-emitting device was made 4 mm and an electric potential of 1 kV was applied to the anode electrode 44 by a high-voltage power source 43. In this state, a rectangular pulse voltage having a crest value of 17 V was applied between the auxiliary electrodes 2, 3 by the use of the power source 41. Then, the device current If and the electron emission current Ie of the electron-emitting device of this example and those of the comparative examples were measured by the ampere meter 40 and the ampere meter 42.

A stable electron emission current Ie could not be measured for the electron-emitting device of the Comparative example 2'. It is thought that this is because the "activation" processing was used for the manufacturing process whereas silicon oxide was not used directly below the gap 8 for the electron-emitting device of the Comparative example 2'. That is, it is estimated that because the electron-emitting device of the Comparative example 2' could not be subjected to the sufficient "activation" processing, a stable electron emission current Ie could not be measured.

Table 2 shows a comparison of electron emission current, electron emission efficiency, and drive time that passed until the electron emission current decreased one-half between the electron-emitting device of this Example 2 and the electron-emitting device of the Comparative example 2 with reference to the values of the electron-emitting device of the Comparative example 2. As shown in Table 2, the electron-emitting device according to the present invention could keep excellent electron emission characteristics for a long time. In this regard, when the characteristics of the electron-emitting device of this Example 2 were evaluated in the same way with the electric potential of the first auxiliary electrode 2 made higher than the electric potential of the second auxiliary electrode 3, all of the electron emission current, the electron emission efficiency, and the drive time that passed until the electron emission current decreased one-half decreased.

TABLE 2

| | Electron emission current | Electron emission efficiency | Time to decrease by half |
|---|---|---|---|
| Example 2 | 1.3 | 1.2 | 1.5 |
| Comparative example 2 | 1 | 1 | 1 |

Example 3

This example is an example in which many electron-emitting devices formed by the same method as the method for manufacturing an electron-emitting device in the Example 1 were arranged in the shape of a matrix on a substrate to form an electron source. Further, this example is also an example in which an image display apparatus shown in FIG. 10 was manufactured by the use of this electron source. A process for manufacturing an image display apparatus formed in this example will be described.

(Process for Forming Substrate)

A silicon oxide film was formed on a glass substrate 71. A photoresist was formed on the silicon oxide film in correspondence with the pattern of the first part 5. Then, a depressed portion corresponding to the second part 6 was formed by the dry etching method. Then, $Si_3N_4$ was deposited as material of the second part 6 by the plasma CVD method in such a way as to make the surface of second part 6 nearly flush with the surface of the silicon oxide film. Then, the photoresist was dissolved by an organic solution to lift off the deposited film, whereby a substrate 71 having the second part 6 and the first part 5 arranged adjacently to each other was produced. Here, in this example, the first part 5 was formed of the silicon oxide.

(Process for Forming Auxiliary Electrode)

Figure 14:
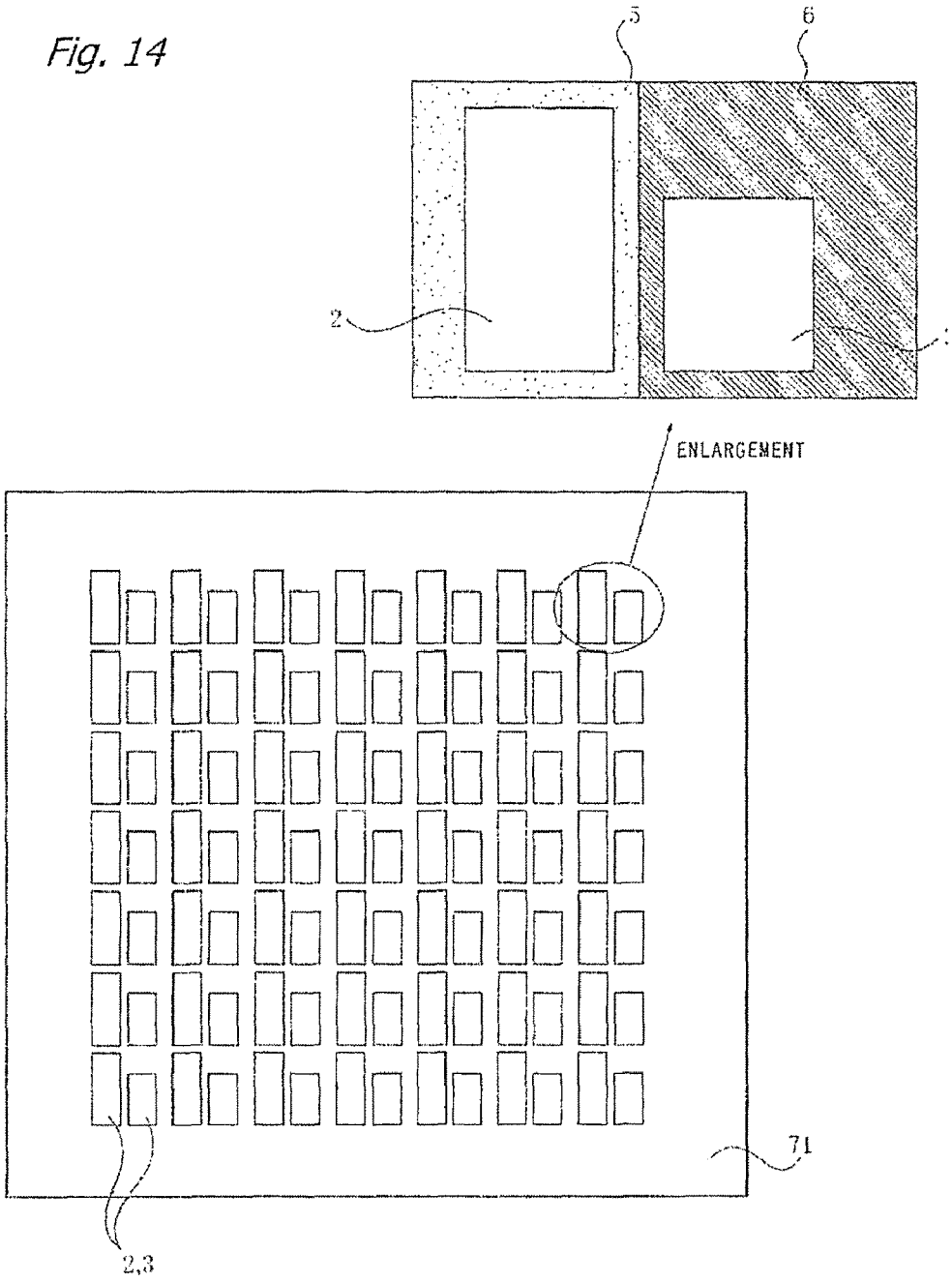
FIG. 14 is a schematic view to show one example of a process for manufacturing an electron source according to the present invention.

Next, many auxiliary electrodes 2, 3 were formed on the substrate 71 (FIG. 14). Specifically, a laminated film of titanium Ti and platinum Pt was formed in a thickness of 40 nm and was patterned by a photolithography method to form the many auxiliary electrodes 2, 3. In this example, the boundary between the first part 5 and the second part 6 was arranged in the center between the auxiliary electrodes 2, 3. Further, the gap L1 between the auxiliary electrodes 2, 3 was made 10 μm and the length W of the gap L1 was made 200 μm.

(Process for Forming Y-Direction Wiring)

Figure 15A:
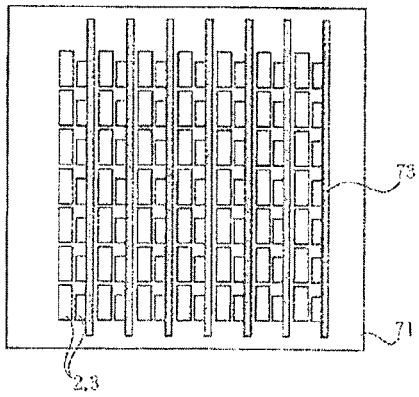
FIGS. 15A to 15D are schematic views to show one example of a process for manufacturing an electron source according to the present invention.

Next, as shown in FIG. 15A, Y-direction wiring 73 having silver as a main component were formed in such a way as to be connected to the auxiliary electrodes 3. This Y-direction wiring 73 function as wiring having a modulation signal applied thereto.

(Process for Forming Insulating Layer)

Figure 15C:
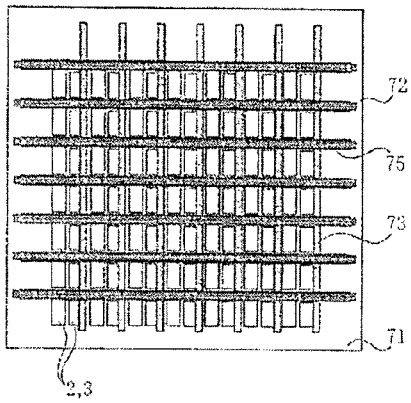
Figure 15B:
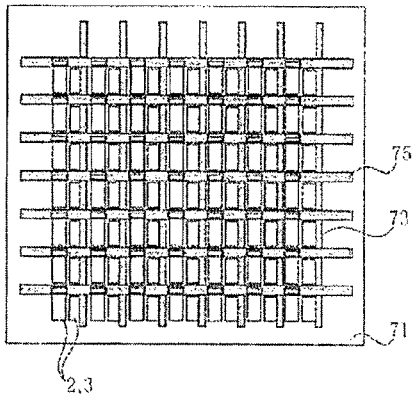

Next, as shown in FIG. 15B, to insulate X-direction wiring 72 to be formed in the next process from the Y-direction wiring 73, insulating layers 75 formed of silicon oxide were arranged. The insulating layers 75 were arranged under the X-direction wiring 72 to be described later in such a way as to cover the previously formed Y-direction wiring 73. Contact holes were formed in portions of the insulating layers 75 in such a way that the X-direction wiring 72 could be electrically connected to the auxiliary electrodes 2.

(Process for Forming X-Direction Wiring)

As shown in FIG. 15C, X-direction wiring 72 having silver as a main component were formed on the previously formed insulating layers 75. The X-direction wiring 72 cross the Y-direction wiring 73 across the insulating layers 75 and were connected to the auxiliary electrodes 2 at the contact holes of the insulating layers 75. This X-direction wiring 72 function as wiring having a scanning signal applied thereto. The substrate 71 having matrix wiring was formed in this manner.

(Process for Forming Conductive Film)

Figure 15D:
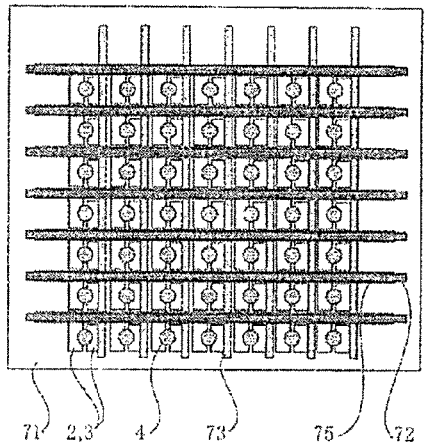
Figure 16A:
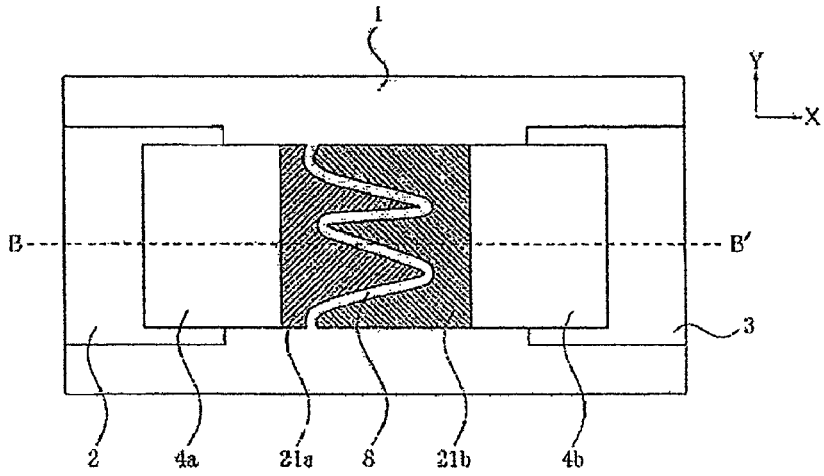
PRIOR ART Fig. 16A
FIGS. 16A and 16B are a schematic plan view and a schematic cross-sectional view to show one example of an electron-emitting device.
Figure 16B:
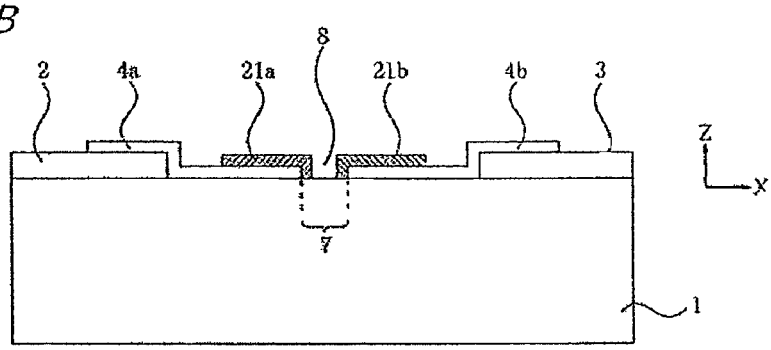
PRIOR ART Fig. 16B
Figure 17A:
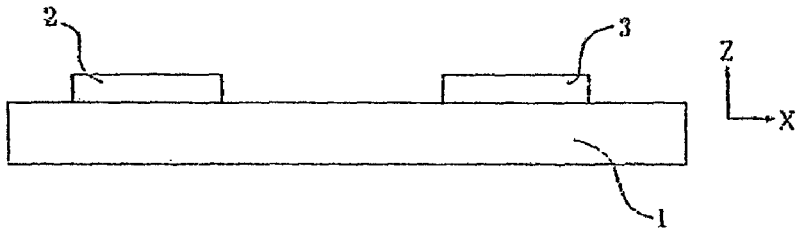
PRIOR ART Fig. 17A
FIGS. 17A to 17D are a schematic cross-sectional views to show one example of a method for manufacturing an electron-emitting device.
Figure 17B:
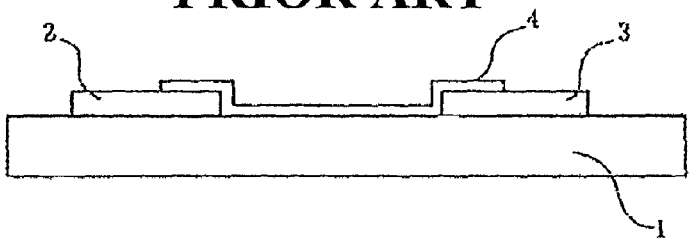
PRIOR ART Fig. 17B
Figure 17C:
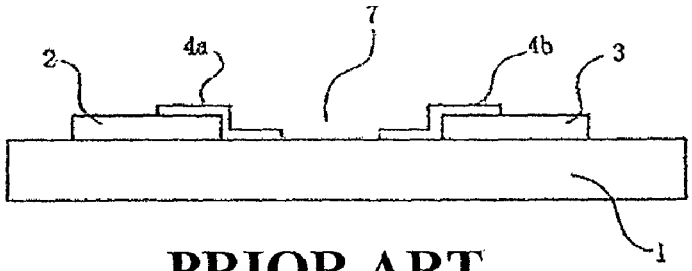
PRIOR ART Fig. 17C
Figure 17D:
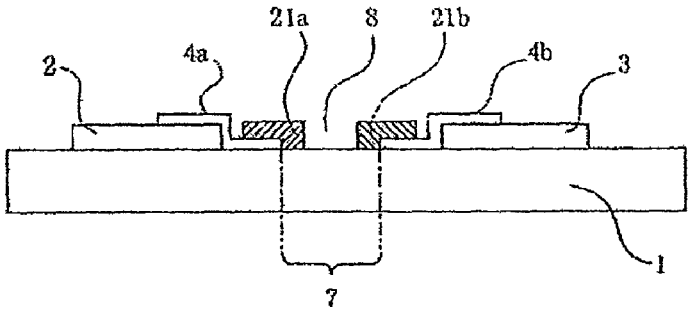
PRIOR ART Fig. 17D

Conductive films 4 were formed between the auxiliary electrodes 2 and the auxiliary electrodes 3 on the substrate 71 having the matrix wiring formed thereon by an ink jet method (FIG. 15D). In this example, an organic palladium complex solution was used as ink used for the ink jet method. This organic palladium complex solution was applied in such a way as to connect the auxiliary electrodes 2 and the auxiliary electrodes 3. Then, this substrate 71 was heated and baked in the air to produce the conductive films 4 made of palladium oxide (PdO).

Thereafter, just as with the Example 1, the gaps 7 were formed in the respective conductive films 4 and then the substrate 71 was subjected to the "activation" processing. In the "activation" processing, the waveform of voltage to be applied to each unit was the same as shown in the method for manufacturing an electron-emitting device of the Example 1.

By the foregoing processes, the substrate 71 having the electron source (the plurality of electron-emitting devices) of this example was formed.

Next, as shown in FIG. 10, a face place 86 in which a luminescent film 84 and a metal back 85 were laminated on the inner surface of a glass substrate 83 was arranged 2 mm above the substrate 71 via a support frame 82.

Then, the join of the face plate 86 and the support frame 82 and the join of the support frame 82 and the substrate 71 were joined by heating and cooling indium (In) of metal having a low melting point. Further, this joining process was performed in a vacuum chamber, so joining and sealing were performed at the same time without using an exhaust pipe.

In this example, the luminescent film 84 of an image forming member was a fluorescent substance formed in the shape of stripes so as to produce a color display (see FIG. 11A). First, black stripes 91 were formed at desired intervals. Subsequently, respective fluorescent substances 92 were applied between the black stripes 91 by a slurry method to produce the luminescent film 84. Material having graphite as a main component was used as the material of the black stripes 91, the graphite being usually used as the material.

Further, a metal back 85 made of aluminum was formed on the inner surface side (electron-emitting device side) of the luminescent film 84. The metal back 85 was manufactured by vacuum evaporating aluminum Al on the inner surface side of the luminescent film 84.

Desired electron-emitting devices were selected through the X-direction wiring and the Y-direction wiring of the image display apparatus completed in this manner and a pulse voltage of 14 V was applied to them. At the same time, a voltage of 10 kV was applied to the metal back 85 through a high-voltage terminal Hv. In this manner, a bright excellent image having little unevenness in brightness and also having little variation in brightness could be displayed for a long time.

The embodiments and examples described above are only examples of the present invention. It is not intended that various modifications of the materials and sizes described above are excluded from the present invention.

This application claims the benefit of Japanese Patent Application No. 2006-202140, filed Jul. 25, 2006, which is hereby incorporated by reference herein in its entirety.

The invention claimed is:

1. An electron-emitting device comprising a first conductive film and a second conductive film that are arranged on a base body with a gap between them and in which an electric potential of the second conductive film is made higher than an electric potential of the first conductive film to emit an electron, wherein the base body includes a first part and a second part, the second part having a lower thermal conductivity than the first part and being arranged adjacently to the first part;

wherein the first conductive film is formed on the first part and the second conductive film is formed on the second part; and wherein at least part of the gap is located over both the first part and the second part.

2. An electron-emitting device according to claim 1, wherein the first part and the second part are of higher resistance than the conductive films and wherein the conductive films are arranged on the first part and the second part.

3. An electron-emitting device according to claim 1, wherein the first conductive film includes a first electrode and a first carbon film; and wherein the second conductive film includes at least a second electrode, which is arranged separately from the first electrode, and a second carbon film which is arranged separately from the first carbon film.

4. An electron-emitting device according to claim 1, wherein material constructing the first part and the second part has a resistivity of $10^8$ Ωm or more.

5. An electron-emitting device according to claim 1, wherein a sheet resistance of the conductive film is $10^2$Ω/□ or more and $10^7$Ω/□ or less.

6. An electron-emitting device according to claim 1, wherein the first part has silicon oxide as a main component.

7. An electron source comprising a plurality of electron-emitting devices, wherein the electron-emitting devices are electron-emitting devices according to claim 1.

8. An image display apparatus comprising an electron source and a light-emitting member that emits light when it is irradiated with an electron emitted from the electron source, wherein the electron source is an electron source according to claim 7.

9. An information reproducing apparatus comprising at least a receiver that outputs at least one of image information, character information, and voice information, which are included in a received broadcast signal, and an image display apparatus connected to the receiver, wherein the image display apparatus is the image display apparatus according to claim 8.

10. An electron-emitting device comprising a first conductive film and a second conductive film that are arranged separately from each other on a base body and in which an electric potential of the second conductive film is made higher than an electric potential of the first conductive film to emit an electron, wherein the base body includes a first part and a second part, the second part having a lower thermal conductivity than the first part and being arranged adjacently to the first part;

wherein the first conductive film is formed on the first part and the second conductive film is formed on the second part; and wherein at least part of a boundary between the first part and the second part is located between the first conductive film and the second conductive film, under a gap over both the first part and the second part.

11. An electron-emitting device according to claim 10, wherein the first part and the second part are of higher resistance than the conductive films and wherein the conductive films are arranged on the first part and the second part.

12. An electron-emitting device according to claim 10, wherein the first conductive film includes a first electrode and a first carbon film; and wherein the second conductive film includes at least a second electrode, which is arranged separately from the first electrode, and a second carbon film which is arranged separately from the first carbon film.

13. An electron-emitting device according to claim 10, wherein material constructing the first part and the second part has a resistivity of $10^8$ Ωm or more.

14. An electron-emitting device according to claim 10, wherein a sheet resistance of the conductive film is $10^2$Ω/□ or more and $10^7$Ω/□ or less.

15. An electron-emitting device according to claim 10, wherein the first part has silicon oxide as a main component.

16. An electron source comprising a plurality of electron-emitting devices, wherein the electron-emitting devices are electron-emitting devices according to claim 10.

17. An image display apparatus comprising an electron source and a light-emitting member that emits light when it is irradiated with an electron emitted from the electron source, wherein the electron source is an electron source according to claim 16.

18. An information reproducing apparatus comprising at least a receiver that outputs at least one of image information, character information, and voice information, which are included in a received broadcast signal, and an image display apparatus connected to the receiver, wherein the image display apparatus is the image display apparatus according to claim 17.

* * * * *